US009933714B2

(12) United States Patent
Inagaki et al.

(10) Patent No.: US 9,933,714 B2
(45) Date of Patent: Apr. 3, 2018

(54) ELECTROPHOTOGRAPHIC PHOTORECEPTOR AND IMAGE-FORMING APPARATUS

(71) Applicant: Konica Minolta, Inc., Tokyo (JP)

(72) Inventors: Keiichi Inagaki, Hino (JP); Seijiro Takahashi, Kokubunji (JP); Hiroshi Nakahara, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/276,177

(22) Filed: Sep. 26, 2016

(65) Prior Publication Data

US 2017/0090306 A1 Mar. 30, 2017

(30) Foreign Application Priority Data

Sep. 30, 2015 (JP) ..... 2015-192430

(51) Int. Cl.
*G03G 5/14* (2006.01)
*G03G 5/147* (2006.01)
(Continued)

(52) U.S. Cl.
CPC ..... *G03G 5/144* (2013.01); *G03G 5/043* (2013.01); *G03G 5/0696* (2013.01);
(Continued)

(58) Field of Classification Search
CPC .. G03G 5/144; G03G 5/14734; G03G 5/0614; G03G 5/14704; G03G 5/14708; G03G 5/0696
See application file for complete search history.

(56) References Cited

U.S. PATENT DOCUMENTS 5,958,638 A * 9/1999 Katayama ..... G03G 5/0659 430/131
2003/0082470 A1* 5/2003 Asano ..... G03G 5/142 430/60
(Continued)

FOREIGN PATENT DOCUMENTS

JP 2012198278 A 10/2012
JP 2012252301 A * 12/2012
(Continued)

OTHER PUBLICATIONS

English language machine translation of JP 2012-252301 (Dec. 2012).*
(Continued)

*Primary Examiner* — Christopher D Rodee
(74) *Attorney, Agent, or Firm* — Lucas & Mercanti, LLP

(57) ABSTRACT

Provided is an electrophotographic photoreceptor including a conductive support having thereon an intermediate layer, a charge generating layer, a charge transporting layer, and a protective layer sequentially laminated in that order, wherein the intermediate layer contains rutile type titanium oxide particles, and 50% or more of the rutile type titanium oxide particles have an organic compound on a surface of the titanium oxide particles; the charge generating layer has a pigment containing a 2,3-butanediol adduct of a phthalocyanine compound; the charge transporting layer contains a charge transporting material having an ionization potential of 5.45 to 5.60 eV; and the protective layer contains metal oxide particles and the charge transporting material in a cured resin prepared by curing a polymerizable compound.

4 Claims, 2 Drawing Sheets

(51) Int. Cl.
*G03G 5/06* (2006.01)
*G03G 5/043* (2006.01)

(52) U.S. Cl.
CPC ..... *G03G 5/14704* (2013.01); *G03G 5/14708* (2013.01); *G03G 5/14734* (2013.01); *G03G 5/14791* (2013.01)

(56) References Cited

U.S. PATENT DOCUMENTS

2004/0191654 A1* 9/2004 Sakimura ..... G03G 5/0614 430/58.05
2005/0266328 A1* 12/2005 Yanagawa ..... G03G 5/0542 430/66
2014/0377702 A1* 12/2014 Nakahara ..... G03G 5/144 430/131
2015/0099217 A1* 4/2015 Hatano ..... G03G 5/0575 430/56

FOREIGN PATENT DOCUMENTS

JP 2013-257504 A 12/2013
JP 2014-211534 A 11/2014
JP 2014211534 A * 11/2014
WO 2009/072637 A1 6/2009

OTHER PUBLICATIONS

English language machine translation of JP 2014-211534 (Nov. 2014).*
Official Notice of Reasons for Rejection dated Jan. 9, 2018 from the corresponding Japanese Application No. JP 2015-192430 and English translation.

* cited by examiner

ELECTROPHOTOGRAPHIC PHOTORECEPTOR AND IMAGE-FORMING APPARATUS

This application is based on Japanese Patent Application No. 2015-192430 filed on Sep. 30, 2015 with Japan Patent Office, the entire content of which is hereby incorporated by reference.

TECHNICAL FIELD

The present invention relates to an electrophotographic photoreceptor and an image-forming apparatus. In particular, the present invention relates to a highly sensitive electrophotographic photoreceptor that hardly produces an exposure memory, and produces an invariable image density even after repeated usage, and an image-forming apparatus provided with this electrophotographic photoreceptor.

BACKGROUND

In recent years, there has been increased frequency in use of copying machines and printers employing an electrophotographic method accompanied with the development of electronic devices. An active research has been made in the field of an electrophotographic photoreceptor used for an image-forming apparatus employing an electrophotographic method to obtain a highly sensitive electrophotographic photoreceptor (hereafter, it may be simply called as "a photoreceptor") and a charge generating material used for the photoreceptor.

For example, Patent document 1 (JP-A No. 2012-198278) discloses a highly sensitive photoreceptor in which a 2,3-butanediol adduct of titanyl phthalocyanine is contained as a charge generating material in a charge generating layer. This compound is highly sensitive and hardly deteriorating the performance by the environmental change. Further, titanium oxide particles excellent in electron transporting property are contained in an intermediate layer in the photoreceptor.

In the high sensitive photoreceptor as described above, there will often remain carriers produced in an exposed portion in a first rotation. As a result, it is difficult to obtain a uniform surface electric potential during a charging process in a second rotation. Consequently, it may be produced a so-called exposure memory in which the exposed portion in the first rotation is distinctly observed in the half-tone image produced in the second rotation.

Here, in order to restrain the generation of the exposure memory, it is efficient to incorporate metal oxide particles having a low electron transporting property in the intermediate layer, or to incorporate a charge transporting material having a large ionization potential in the charge transporting layer. However, this will produce a problem that the image density will be changed due to the decrease of the sensitivity after the repeated usage.

Therefore, it is required a highly sensitive photoreceptor that hardly produces an exposure memory, and produces an invariable image density even after repeated usage.

SUMMARY

The present invention was done based on the above-described problems and situations. An object of the present invention is to provide a highly sensitive electrophotographic photoreceptor that hardly produces an exposure memory, and produces an invariable image density even after repeated usage, and to provide an image-forming apparatus provided with this electrophotographic photoreceptor.

The present inventors have made investigation to solve the above-described problems, and have found out to provide a photoreceptor that hardly produces an exposure memory, and excellent in electric potential stability and produces an invariable image density even after repeated usage by suitably adjusting the following: an electron transporting property of titanium oxide in an intermediate layer; a hole transporting property of a charge transporting material in a protective layer; and an ionization potential of a charge transporting material in a charge transporting layer. Thus the present invention has been achieved.

Namely, the problems relating to the present invention are solved by the following embodiments.

1. An electrophotographic photoreceptor comprising a conductive support having thereon an intermediate layer, a charge generating layer, a charge transporting layer, and a protective layer sequentially laminated in that order, wherein the intermediate layer contains rutile type titanium oxide particles, and 50% or more of the rutile type titanium oxide particles have an organic compound on a surface of the titanium oxide particles;

the charge generating layer has a pigment containing a 2,3-butanediol adduct of a phthalocyanine compound;

the charge transporting layer contains a charge transporting material having an ionization potential of 5.45 to 5.60 eV; and the protective layer contains metal oxide particles and the charge transporting material in a cured resin prepared by curing a polymerizable compound.
2. The electrophotographic photoreceptor described in the embodiment 1, wherein the organic compound on the surface of the titanium oxide particles is a reactive organosilicon compound.
3. The electrophotographic photoreceptor described in the embodiment 2, wherein the reactive organosilicon compound is at least one selected from the group consisting of 3-methacryloxy propyl trimethoxy silane, 3-acryloxy propyl trimethoxy silane, and methyl hydrogen polysiloxane.
4. An image-forming apparatus provided with any one of the electrophotographic photoreceptor described in the embodiments 1 to 3, a charging unit to charge the electrophotographic photoreceptor, an exposing unit, a developing unit, and a transferring unit.

By the above-described embodiments of the present invention, it can provide a highly sensitive electrophotographic photoreceptor that hardly produces an exposure memory, and produces an invariable image density even after repeated usage, and an image-forming apparatus installed with this electrophotographic photoreceptor.

A formation mechanism or an action mechanism of the effects of the present invention is not made clear, but it is supposed to be as follows.

When a photoreceptor has an intermediate layer containing titanium oxide having an electron transporting property, the higher the electron transporting property of titanium oxide, the more promoted dissociation of carrier pairs produced in an exposure portion. As a result, an amount of the produced holes will be increased and an exposure memory will be likely produced.

The intermediate layer of the present invention contains rutile type titanium oxide as an electron transporting material, and 50% or more of the rutile type titanium oxide particles have an organic compound on a surface of the titanium oxide particles. Among titanium oxide particles, the rutile type titanium oxide particles have a suitable electron transporting property. As a result, they prevented release of electrons from the charge generating layer, therefore, it is supposed that generation of an exposure memory was restrained. Further, by the composition that 50% or more of the titanium oxide particles have an organic compound on a surface of the particles, dispersion property of the particles is improved, and the electrons will not remain in the intermediate layer after repeated usage. It is supposed that this is the reason of achieving invariable image density.

In the present invention, "rutile type titanium oxide particles having an organic compound on a surface of the particles" indicate the case in which only a surface treatment with an organic compound is carried out to untreated rutile type titanium oxide particles. It does not indicate the case in which a surface treatment with an inorganic compound is carried out to untreated rutile type titanium oxide particles, followed by carrying out a surface treatment with an organic compound.

In the photoreceptor, the less the ionization potential of the charge transporting material, the more likely remain the carriers generated in an exposure portion of a first rotation. Consequently, the exposure memory tends to be produced.

The charge transporting material of the present invention has an ionization potential in the range of 5.45 to 5.60 eV. Since the charge transporting material has a large ionization potential of 5.45 eV or more, the carriers generated in an exposure portion are not likely remained. It is supposed that this will result in restraining generation of an exposure memory. In addition, since the ionization potential is made to be 5.60 eV or less, the remaining electric potential will not be increased too much. Thus, it is supposed that variation of image density was restrained.

The protective layer of the present invention incorporates at least metal oxide particles and a charge transporting material in a cured resin. By incorporating the metal oxide particles in the protective layer, the resistivity of the protective layer may be adjusted. Consequently, even when the charge transporting material is contained, it is supposed that generation of an exposure memory will not likely occur.

The photoreceptor of the present invention has: an intermediate layer; a charge transporting layer; and a protective layer, as described above. Consequently, as a whole, it has a layer composition in which generation of an exposure memory will not likely occur, and image density will be invariable even after repeated usage. Therefore, even when it is used a highly sensitive photoreceptor having a 2,3-butanediol adduct of a phthalocyanine compound in a charge generating layer as a charge generating material, it is supposed that generation of an exposure memory will not likely occur, and image density will be invariable even after repeated usage.

DESCRIPTION OF THE PREFERRED EMBODIMENTS

Figure 1:
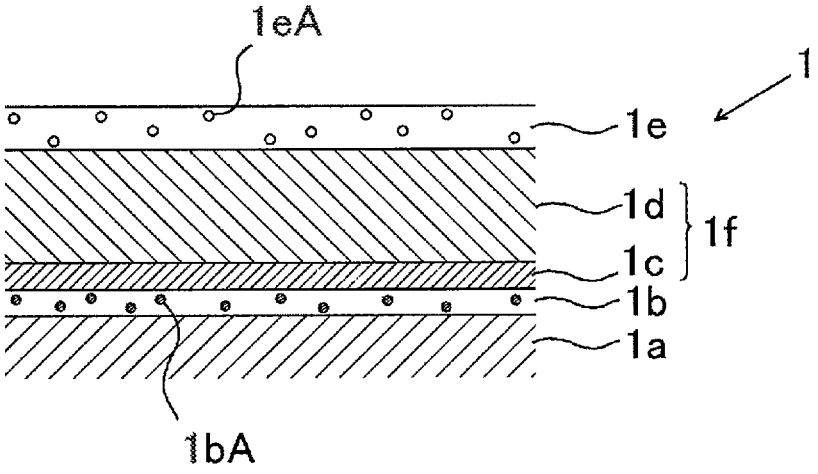
FIG. 1 is a partial cross-sectional view illustrating a layer configuration of an electrophotographic photoreceptor of the present invention.

An electrophotographic photoreceptor of the present invention is an electrophotographic photoreceptor comprising a conductive support having thereon an intermediate layer, a charge generating layer, a charge transporting layer, and a protective layer sequentially laminated in that order, wherein the intermediate layer contains rutile type titanium oxide particles, and 50% or more of the rutile type titanium oxide particles have an organic compound on a surface of the titanium oxide particles; the charge generating layer has a pigment containing a 2,3-butanediol adduct of a phthalocyanine compound; the charge transporting layer contains a charge transporting material having an ionization potential of 5.45 to 5.60 eV; and the protective layer contains metal oxide particles and a charge transporting material in a cured resin prepared by curing a polymerizable compound. This feature is a technical feature commonly owned by the above-described embodiments 1 to 4.

As an embodiment of the present invention, in order to improve dispersion property of the titanium oxide particles in the intermediate layer, it is preferable to use a reactive organosilicon compound as an organic compound.

As an embodiment of the present invention, in order to further improve dispersion property of the titanium oxide particles in the intermediate layer, it is preferable to use a compound selected from the group consisting of 3-methacryloxy propyl trimethoxy silane, 3-acryloxypropyl trimethoxy silane, and methyl hydrogen polysiloxane as the reactive organosilicon compound.

The electrophotographic photoreceptor of the present invention is suitably used for an image-forming apparatus provided with at least: a charging unit to charge the photoreceptor; an exposing unit; a developing unit; and a transferring unit.

The present invention and the constitution elements thereof, as well as configurations and embodiments, will be detailed in the following. In the present description, when two figures are used to indicate a range of value before and after "to", these figures themselves are included in the range as a lowest limit value and an upper limit value.

An electrophotographic photoreceptor and an image-forming apparatus of the present invention will be specifically described in the following.

[Electrophotographic Photoreceptor]

An electrophotographic photoreceptor 1 of the present invention comprises a conductive support 1*a* having thereon an intermediate layer 1*b*, a charge generating layer 1*c*, a charge transporting layer 1*d*, and a protective layer 1*e* sequentially laminated in that order. It is characterized in that the intermediate layer 1*b* contains rutile type titanium oxide particles 1*b*A, and 50% or more of the rutile type titanium oxide particles 1*b*A have an organic compound on a surface of the titanium oxide particles; the charge generating layer 1*c* has a phthalocyanine compound; the charge transporting layer 1*d* contains a charge transporting material having an ionization potential of 5.45 to 5.60 eV; and the protective layer 1*e* contains metal oxide particles 1*e*A and a charge transporting material in a cured resin prepared by curing a polymerizable compound.

In the present invention, an organic photoreceptor designates a member in which at least one of a charge generating function and a charge transporting function, both being essential to the constitution of the photoreceptor, is exhibited by an organic compound. The organic photoreceptor in the present invention includes: a photoreceptor containing an organic photosensitive layer composed of a known organic charge generating material and a known charge transporting material; and a photoreceptor composed of a polymer complex having a charge generating function and a charge transporting function.

As illustrated in FIG. 1, a photoreceptor has an organic photosensitive layer 1*f*, essential to an organic photoreceptor, composed of a charge generating layer 1*c* and a charge transporting layer 1*d*.

<Conductive Support 1*a*>

Any conductive support may be used in the present invention as long as it has conductivity. Examples of a conductive support include: drums and sheets formed of metals, such as aluminum, copper, chromium, nickel, zinc, and stainless steel; plastic films laminated with a metal foil of aluminum or copper; plastic films provided with deposited layers of aluminum, indium oxide, or tin oxide; and metal and plastic films and paper sheets having conductive layers formed through application of a conductive substance alone or in combination with a binder resin.

<Intermediate Layer 1*b*>

An intermediate layer of the present invention provides a barrier function and an adhesive function between the conductive support and the organic photosensitive layer.

An intermediate layer that composes a photoreceptor of the present invention has rutile type titanium oxide particles in a binder resin (hereafter, it is called as "a binder resin for an intermediate layer"). The intermediate layer contains the rutile type titanium oxide particles, and 50% or more of the rutile type titanium oxide particles have an organic compound on a surface of the titanium oxide particles.

Examples of a binder resin for an intermediate layer include: polyamide resins, casein, poly(vinyl alcohol) resins, nitrocellulose, ethylene-acrylic acid copolymers, vinyl chloride resins, vinyl acetate resins, polyurethane resins, and gelatin.

Among these binder resins, preferred are polyamide resins from the viewpoint of inhibiting dissolution of the binder resin for an intermediate layer when a coating liquid for forming a charge generating layer described later is coated on the intermediate layer. Further, since the rutile type titanium oxide particles having an organic compound on the surface of the particles of the present invention are suitably dispersed in an alcoholic solvent, it is preferable to use alcohol-soluble polyamide resins such as methoxy methylol polyamide resins.

(Rutile Type Titanium Oxide Particles 1*b*A)

Titanium oxide contained in the intermediate layer gives a suitable electron transporting property to the intermediate layer. From the viewpoint of preventing too much electrons from releasing from the charge generating layer, it is preferable that 50% or more of the titanium oxide is contained as rutile type titanium oxide particles having an organic compound on a surface of the titanium oxide particles. It is more preferable that 60% or more of the titanium oxide is contained as described above.

In addition, as mentioned above, in the present invention, "rutile type titanium oxide particles have an organic compound on a surface of the particles" indicate the case in which only a surface treatment with an organic compound is carried out to untreated rutile type titanium oxide particles. It does not indicate the case in which a surface treatment with an inorganic compound is carried out to untreated rutile type titanium oxide particles, followed by carrying out a surface treatment with an organic compound.

Further, in the following description, "rutile type titanium oxide particles have an organic compound on a surface of the particles" may be called as "rutile type titanium oxide particles subjected to an organic treatment".

When anatase type titanium oxide particles are used instead of rutile type titanium oxide particles, generation of an exposure memory will likely occur. The reason of this is supposed to be as follows. Although the anatase type titanium oxide particles have a superior electron transporting property to the rutile type titanium oxide particles, the anatase type titanium oxide particles will release too much electrons from the charge generating layer, and generation of thermally excited carriers will be increased.

When rutile type titanium oxide particles subjected to a surface treatment with an inorganic compound such as an inorganic oxide (hereafter, it is called as "subjected to an inorganic treatment") are used, the electron transporting property will be decreased. As a result, the amount of charge accumulated in the charge generating layer will be decreased and generation of an exposure memory will be restrained. However, when the electrons remain in the intermediate layer by the repeated usage to result in increasing the surface electric potential, the sensitivity will be decreased and the image density tends to be varied.

As an organic surface treatment agent changing the rutile type titanium oxide particles into the rutile type titanium oxide particles having an organic compound on a surface of the particles starting, it can be used the following: an alkoxy silane represented by Formula (a); an organosilicon compound such as methyl hydrogen polysiloxane; and an organic titanium compound. Among them, it is preferable to use an organosilicon compound from the viewpoint of improving a dispersion property of the titanium oxide particles in the intermediate layer.

$$R_5—Si—(X)_3 \qquad \text{Formula (a)}$$

In Formula (a), $R_5$ represents an alkyl group of 1 to 10 carbon atoms containing a methacryloxy group or an acryloxy group, and X represents an alkoxy group of 1 to 4 carbon atoms.

Specific examples of an alkoxy silane represented by Formula (a) are: 3-methacryloxypropyl trimethoxy silane, 3-methacryloxypropyl triethoxy silane, 3-acryloxypropyl trimethoxy silane, 3-acryloxypropyl triethoxy silane, 2-methacryloxyethyl trimethoxy silane, and 3-methacryloxy butyl trimethoxy silane. Among them, it is preferable to use 3-methacryloxypropyl trimethoxy silane or 3-acryloxypropyl trimethoxy silane. It is more preferable to use 3-methacryloxypropyl trimethoxy silane. These may be used singly, or they may be used in combination of two or more kinds.

Methyl hydrogen polysiloxane is a kind of polysiloxane containing a structure unit of a methyl hydrogen siloxane unit: $—(HSi(CH_3)O)—$. It is preferable to use a copolymer made of this unit and other siloxane unit than this unit. As other siloxane unit, it can be cited: a dimethyl siloxane unit, a methyl ethyl siloxane unit, a methyl phenyl siloxane unit, and a diethyl siloxane unit. It may be contained two or more kinds. Since methyl hydrogen polysiloxane has a high surface treatment effect, it is preferable to use a compound having a molecular weight of 1,000 to 20,000.

Examples of a usable organic titanium compound are: alkoxy titanium, titanium polymer, titanium acylate, titanium chelate, tetrabutyl titanate, tetraoctyl titanate, isopropyl triisostearoyl titanate, isopropyl tridecyl benzenesulfonyl titanate, and bis(dioctyl pyrophosphate)oxyacetate titanate.

A surface treatment method of rutile type titanium oxide with an organic surface treatment agent is not limited in particular, and a known method may be applied. It may be adopted a wet or a dry surface treatment method.

Examples of a dry surface treatment method are as follows: the particles to be treated are dispersed in a cloud condition, then, a surface treatment solution containing an organic surface treatment agent dissolved in a solvent is sprayed to these particles; or a vaporized surface treatment solution is contacted with these particles to adhere the surface treatment agent.

Examples of a wet surface treatment method are as follows: the particles to be treated are added to a surface treatment solution containing an organic surface treatment agent dissolved or dispersed in an organic solvent, then mixed with stirring; or the particles to be treated are dispersed in a surface treatment solution, then, an organic surface treatment agent is dropwise added to adhere to the particles, afterwards, a wet pulverization treatment is carried out with a method such as a bead mill. Then the solvent is removed from the dispersion liquid under the reduced pressure. The obtained treated particles are subjected to an annealing treatment. Among the above-described surface treatments, a wet surface treatment is preferable because of its easy handling.

As a solvent used for preparing a surface treatment solution, it is preferable to use an organic solvent. Examples of a solvent are: aromatic hydrocarbon solvents such as benzene, toluene, and xylene; ether solvents such as tetrahydrofuran and dioxane.

The mixing and stirring in the wet surface treatment method are suitably done until the moment of obtaining a sufficient degree of dispersion of the particles to be treated. The temperature for the wet pulverization treatment is preferably about 15 to 100° C., and it is more preferably about 20 to 50° C. The time for the pulverization treatment is preferably 0.5 to 10 hours, more preferably, it is 1 to 5 hours. The baking temperature in the annealing treatment may be made to be, for example, 100 to 220° C., and more preferably, it may be made to be 110 to 150° C. A preferable baking time is 0.5 to 10 hours, and more preferably, it is 1 to 5 hours. These conditions are only examples, and they may be changed according to the treatment apparatus employed. Therefore, the treatment may be done outside the conditions as described above.

An amount of the organic surface treating agent used in the wet surface treatment method depends on the kinds of the agent. For example, it may be used 0.1 to 20 mass parts of the organic surface treating agent with respect to 100 mass parts of the particles to be treated. More preferably, it may be used 1 to 15 mass parts of the organic surface treating agent. An amount of the solvent added is preferably 100 to 600 mass parts with respect to 100 mass parts of the particles to be treated. More preferably, it may be used 200 to 500 mass parts of the solvent.

When the amount of the organic surface treating agent used is above the lowest limit value as described above, sufficient surface treatment can be made to the particles to be treated. Consequently, the intermediate layer may be provided with a suitable electron transporting property. On the other hand, when the amount of the organic surface treating agent used is below the upper limit value as described above, it may be prevented the mutual reaction of the organic surface treating agents. As a result, it may be prevented generation of leak caused by non-adhesion of a uniform coating film on the surface of the particles to be treated.

Confirmation of the surface treatment of the rutile type titanium oxide particles contained in the intermediate layer may be done by the checking the production steps, or by an inorganic analysis of the surface of the rutile type titanium oxide particles contained in the intermediate layer. The inorganic analysis is done with an energy dispersive X-ray analysis employing an additional device of a transmissive electron microscope (TEM-EDX) or a wavelength dispersive fluorescent X-ray analysis (WDX).

A number average primary particle size of the specific rutile type titanium oxide particles is preferably 5 to 100 nm, for example. More preferably, it is 10 to 50 nm.

By the fact that the number average primary particle size of the specific rutile type titanium oxide particles is within the above described range, it may be obtained a suitable electron transporting property without deteriorating the dispersion property.

The number average primary particle size of the specific rutile type titanium oxide particles may be measured as follows. The specific rutile type titanium oxide particles are photographed at a magnification of 100,000 with a transmissive electron microscope (TEM). The 100 particles are randomly selected. Feret's diameters of the randomly selected 100 particles are calculated with an image analysis, and the average value of the Feret's diameters is defined as "a number average primary particle size".

A content of the specific rutile type titanium oxide particles is preferably 20 to 400 mass parts with respect to 100 mass parts of the binder resin for the intermediate layer. More preferably, it is 50 to 350 mass parts.

By the fact that the content of the specific rutile type titanium oxide particles is above 20 mass parts with respect to 100 mass parts of the binder resin for the intermediate layer, it is securely obtained an electron transporting property in the intermediate layer. On the other hand, by the fact that the content of the specific rutile type titanium oxide particles is less than 400 mass parts with respect to 100 mass parts of the binder resin for the intermediate layer, it may be prevented inhibition of formation of the coating film when the intermediate layer is formed.

In order to adjust the resistivity, the intermediate layer may contain the rutile type titanium oxide particles subjected to an inorganic treatment in addition to the rutile type titanium oxide particles subjected to an organic treatment.

The adjustment of the resistivity of the intermediate layer may be done by controlling the content of the rutile type titanium oxide particles subjected to an organic treatment. When the content of the rutile type titanium oxide particles subjected to an organic treatment is too small, the intermediate layer may be affected by the environmental change caused by the binder resin for the intermediate layer. Therefore, it is preferable to incorporate the titanium oxide particles subjected to an inorganic treatment.

When the titanium oxide particles subjected to an inorganic treatment are incorporated in addition to the rutile type titanium oxide particles subjected to an organic treatment, although it depends on the electron transporting property of the titanium oxide particles subjected to an organic treatment, the content of the titanium oxide particles subjected to an inorganic treatment is adjusted to be less than 50 mass % of the total amount of titanium oxide contained in the intermediate layer.

In the above-described intermediate layer, it may be contained other metal oxide particles than the above-described titanium oxide particles. The other metal oxide particles are not limited in particular. Examples are particles of metal oxides such as: zinc oxide, alumina (aluminum oxide), silica (silicon oxide), tin oxide, antimony oxide, indium oxide, bismuth oxide, magnesium oxide, lead oxide, tantalum oxide, yttrium oxide, cobalt oxide, copper oxide, manganese oxide, selenium oxide, iron oxide, zirconium oxide, germanium oxide, niobium oxide, molybdenum oxide, and vanadium oxide; and particles of tin-doped indium oxide, antimony-doped tin oxide, and antimony-doped zirconium oxide. These metal oxide particles may be used alone or in combination of two or more kinds. A mixture of two or more metal oxides particles may be in the form of solid solution or fusion. Such metal oxide particles preferably have a number average primary particle size of 300 nm or less, more preferably it is 100 nm or less.

(Forming Method of Intermediate Layer)

The intermediate layer as described above may be formed with the following method, for example. The binder resin for the intermediate layer is dissolved or dispersed in a solvent. Subsequently, the specific rutile type titanium oxide particles are uniformly dispersed in this liquid to obtain a dispersion liquid. The obtained dispersion liquid is left still, then, it is filtered to prepare a coating liquid for forming an intermediate layer. This coating liquid for forming an intermediate layer is applied on a surface of a conductive support to form a coating film. The intermediate layer may be formed by drying this coating film.

As a solvent used for formation of the intermediate layer, it is sufficient that it will dissolve the binder resin for the intermediate layer, and it will give a good dispersion property for the specific rutile type titanium oxide particles. For example, when a polyamide resin is used for a binder resin for an intermediate layer, the following solvents are preferably used from the viewpoint of realizing a good dissolving property and a coating property. Examples of a preferable solvent are alcohols such as: methanol, ethanol, n-propyl alcohol, isopropyl alcohol, n-butanol, t-butanol, and sec-butanol. These solvents may be used solely or they may be used as a mixed solvent of two or more kinds.

In order to increase the storage stability and the dispersion property of the specific rutile type titanium oxide particles, it may be used an auxiliary solvent. Examples of an auxiliary solvent are: benzyl alcohol, toluene, cyclohexanone, and tetrahydrofuran.

As a dispersing method of the specific rutile type titanium oxide particles, it may be cited: an ultrasonic disperser, a bead mill, a ball mill, a sand mill, and a homo mixer.

The amount of the binder resin for an intermediate layer in the coating liquid for forming an intermediate layer depends on the thickness of the intermediate layer or the coating method. The amount of the employed solvent is preferably 100 to 3,000 mass parts with respect to 100 mass part of the binder resin for an intermediate layer. More preferably, the amount of the employed solvent is 500 to 2,000 mass parts.

A coating method of a coating liquid for forming an intermediate layer is not limited in particular. Examples thereof are known methods such as: a dip coating method, a spray coating method, a spinner coating method, a bead coating method, a blade coating method, a beam coating method, and a slide hopper method.

A drying method of the coating film may be suitably selected from the known drying methods according to the kinds of solvent and the thickness of the formed intermediate layer. The drying conditions may be at the temperature of 100 to 150° C. for 10 to 60 minutes.

The thickness of the intermediate layer is preferably 0.5 to 15 μm, more preferably, it is 1 to 7 μm.

When the thickness of the intermediate layer is too small, the intermediate layer may not cover an entire surface of the conductive support. Therefore, it may not sufficiently block the injection of the holes from the conductive support. As a result, there is a possibility in which generation of image defects such as black spot or a fog may not be sufficiently suppressed. On the other hand, when the thickness of the intermediate layer is too large, an electric resistance will be increased. Therefore, a sufficient electron transporting property may not be obtained. As a result, there is a possibility in which generation of unevenness of image density may not be sufficiently suppressed.

<Charge Generating Layer 1*c*>

A charge generating layer contains a 2,3-butanediol adduct of a phthalocyanine compound as a charge generating material (CGM). The charge generating layer may contain a binder resin (hereafter, it may be called as "a binder resin for a charge generating layer") according to necessity. Further, other additive may be contained.

(Phthalocyanine Compound)

As a phthalocyanine compound, it may be used a phthalocyanine compound having a central metal. It is preferable to use a phthalocyanine compound having a central metal of one selected from the group consisting of Ti, Fe, V, Ga, Si, Pb, Al, Zn and Mg. Among them, it is more preferable to use a titanyl phthalocyanine compound having Ti as a central metal. Particularly preferable compounds are: Y type titanyl phthalocyanine that has a maximum peak at a Bragg angle 27.3° (2θ±0.2), and clear diffraction peaks at 7.4°, 9.7°, and 24.2° with X-ray diffraction using CuKα rays; and a 2,3-butanediol adduct of titanyl phthalocyanine that has clear diffraction peaks at Bragg angles 8.3°, 24.7°, 25.1°, and 26.5°. These compounds are highly sensitive, and they exhibit large stabilizing effect when combined with a perylene compound. Therefore, they are particularly preferable.

As a charge generating material, it may co-use other charge generating material than a phthalocyanine compound. Examples of other charge generating material include: quinone pigments such as pyrenequinone and anthanthrone; perylene pigments; azo pigments such as trisazo pigments, disazo pigments, and monoazo pigments; indigo pigments; quinacridone pigments; quinocyanine pigments; and azulenium pigments. These may be used solely, or they may be used by mixing two or more kinds.

Known resins can be used as a binder resin for a charge generating layer. Examples thereof include: formal resins, butyral resins, silicone resins, silicone-modified butyral resins, and phenoxy resins.

The amount of the charge generating material contained in the charge generating layer is preferably 20 to 600 mass parts with respect to 100 mass parts of the binder resin for the charge generating layer. More preferably, the amount is 50 to 500 mass parts.

By making the mixing ratio of the binder resin and the charge generating material in the charge generating layer to be in the above-described ratio, the coating liquid for forming the charge generating layer will acquire high dispersion stability. In addition, the produced photoreceptor will have a reduced electric resistance, and it may highly prevent increase of the residual electric potential caused by repeated use of the photoreceptor.

The above-described charge generating layer may be formed as follows. For example, a charge generating material is added to a binder resin for a charge generating layer dissolved in a known solvent. The mixture is dispersed to prepare a coating liquid for forming a charge generating layer. This coating liquid for forming a charge generating layer is applied on the surface of the intermediate layer to form a coating film. A charge generating layer is produced by drying this coating film.

The solvent used for formation of the charge generating layer is not particularly limited as long as it can dissolve the binder resin for the charge generating layer. Examples of the solvent are: ketone type solvents such as methyl ethyl ketone, methyl isopropyl ketone, methyl isobutyl ketone, cyclohexanone, and acetophenone; ether type solvents such as tetrahydrofuran, dioxolane, and diglyme; alcohol type solvents such as methyl cellosolve, ethyl cellosolve, and butanol; ester type solvents such as ethyl acetate and t-butyl acetate; aromatic solvents such as toluene and chlorobenzene; and halogenated solvents such as dichloroethane and trichloroethane. However, the present invention is not limited to them. These solvents may be used alone, or they may be used by mixing two or more kinds.

As a dispersion method of a charge generating material, it may be cited the same dispersion methods used for dispersing the rutile type titanium oxide particles in the coating liquid for forming the intermediate layer.

As a coating method of the coating liquid for forming the charge generating layer, it may be cited the same coating methods cited for the coating liquid for forming the intermediate layer.

The thickness of the charge generating layer may vary depending on the properties of the charge generating material, the properties of the binder resin, or the amount of the binder resin contained in the layer. The thickness is preferably from 0.01 to 2 μm, more preferably it is from 0.15 to 1.5 μm.

<Charge Transporting Layer 1*d*>

The charge transporting layer in the present invention contains a charge transporting material (CTM) having a hole transporting property and a binder resin (hereafter, it is also called as "a binder resin for a charge transporting layer"). The charge transporting layer may contain additives such as an antioxidant. The charge transporting layer may have a layer configuration of two or more layers.

The charge generating material in the charge generating layer has an ionization potential in the range of 5.45 to 5.60 eV. A preferable ionization potential is in the range of 5.50 to 5.60 eV. By making the ionization potential to be 5.45 eV or more, the carriers generated in the exposure portion will hardly remain. Consequently, generation of an exposure memory may be restrained. By making the ionization potential to be 5.60 eV or less, the residual electric potential will be hardly increased. Consequently, variation of image density may be restrained.

Examples of a charge transporting material which carries charge in a charge transporting layer are: triphenylamine derivatives, hydrazone compounds, styryl compounds, benzidine compounds, and butadiene compounds.

Examples of a binder resin for a charge transporting layer include known resins such as: polystyrene resins, acrylic resins, methacrylic resins, vinyl chloride resin, vinyl acetate resins, polyvinyl butyral resins, epoxy resins, polyurethane resins, phenol resins, polyester resins, alkyd resins, polycarbonate resins, silicone resins, melamine resins, insulating resins such as co-polymer resins containing two or more repeating units of these resins, and organic polymer semiconductor such as poly-N-vinyl carbazole resins. Among them, polycarbonate resins are preferably used from the viewpoint of obtaining an excellent dispersion property of charge transporting material (CTM) and excellent electrophotographic property.

The amount of the charge transporting material contained in the charge transporting layer is preferably 10 to 200 mass parts with respect to 100 mass parts of the binder resin for a charge transporting layer.

The charge transporting layer may contain additives such as an antioxidant, an electron conducting agent, a stabilizer and a silicone oil. An antioxidant is a substance that inhibits or decreases the effect of oxygen under the conditions of light, heat and discharge by an autoxidation material located on the surface or inside of the photoreceptor.

The charge transporting layer may have any thickness depending on the properties of the charge transporting material or the binder resin, or the amount of the binder resin contained in the layer. The thickness is preferably 10 to 40 μm, more preferably it is 10 to 30 μm.

The above-described charge transporting layer is formed as follows. For example, a charge transporting material (CTM) (and an antioxidant when required) is added to a binder resin for a charge transporting layer dissolved in a known solvent. The mixture is dispersed to prepare a coating liquid for forming a charge transporting layer. This coating liquid for forming a charge transporting layer is applied on the surface of the charge generating layer to form a coating film. A charge transporting layer is produced by drying this coating film.

As a solvent used for formation of the charge transporting layer, it may be cited the same solvent used for formation of a charge generating layer.

As a coating method of the coating liquid for forming a charge transporting layer, it may be cited the same coating methods cited for the coating liquid for forming a charge generating layer.

<Protective Layer 1*e*>

The protective layer that constitutes the photoreceptor of the present invention contains metal oxide particles 1*e*A and an electron transporting material in a binder resin (hereafter, it may be called as "a binder resin for a protective layer") made of a cured resin obtained by polymerization reaction of a polymerizable compound.

(Metal Oxide Particles 1*e*A)

The metal oxide particles contribute to improved strength of the protective layer and image stabilization by adjustment of resistance.

Examples of metal oxides particles are particles of: zinc oxide, alumina (aluminum oxide), silica (silicon oxide), tin oxide, antimony oxide, indium oxide, bismuth oxide, magnesium oxide, lead oxide, tantalum oxide, yttrium oxide, cobalt oxide, copper oxide, manganese oxide, selenium oxide, iron oxide, zirconium oxide, germanium oxide, niobium oxide, molybdenum oxide, and vanadium oxide; and particles of tin-doped indium oxide, antimony-doped tin oxide, and antimony-doped zirconium oxide. These metal oxide particles may be used alone or in combination of two or more kinds. A mixture of two or more metal oxides particles may be in the form of solid solution or fusion.

A number average primary particle size of the metal oxide particles is preferably 1 to 300 nm, and more preferably, it is 3 to 100 nm.

The number average primary particle size of the metal oxide particles is determined as follows. The particles are photographed at a magnification of 100,000 with a scanning electron microscope (e.g., JSM-7500F, manufactured by JEOL Ltd.), and the photographic image including randomly selected 100 particles (excluding agglomerated particles) of the metal oxide particles read by a scanner is converted into a binary image with an automatic image analyzer (e.g., "LUZEX AP" with software version Ver. 1.32, manufactured by NIRECO Corporation). The horizontal Feret's diameters of the randomly selected 100 metal oxide particles are calculated, and the average value of the Feret's diameters is defined as the number average primary particle size. Here, the "horizontal Feret's diameter" refers to the length of a side (parallel to the x-axis) of a circumscribed rectangle when an image of the metal oxide particles is subjected to a binary treatment.

The metal oxide particles are preferably contained in an amount of 1 to 200 mass parts with respect to 100 mass parts of the binder resin for a protective layer, more preferably it is 50 to 150 mass parts.

By making the amount of the metal oxide particles to be 1 or more mass parts with respect to 100 mass parts of the binder resin for a protective layer, it may be certainly obtained a sufficient mechanical strength for the protective layer and sufficient image stability. On the other hand, by making the amount of the metal oxide particles to be 200 or less mass parts with respect to 100 mass parts of the binder resin, it may prevent deterioration of the formation of the coating film during the formation of the protective layer.

(Metal Oxide Particles Subjected to Surface Treatment)

The metal oxide particles contained in the protective layer are preferably subjected to a surface treatment with a surface treating agent from the viewpoint of obtaining a good dispersing property and improved abrasion resistance. Further, in order to improve the hardness of the protective layer, it is preferable that the surface treatment is done with a surface treating agent having a reactive organic group. It is more preferable that the reactive organic group is a radical polymerizable reactive group. By using a surface treating agent having a radical polymerizable reactive group, it may form a strong protective layer since it will react with a polymerizable compound when the binder resin for a protective layer is a cured resin made of the following polymerizable compound.

As a surface treating agent, it may be used a surface treating agent that will react with a hydroxy group located on the surface of the untreated metal oxide particles. Examples of such surface treating agent are various types of: silane coupling agent, titanium coupling agents, inorganic compounds, fluorine modified silicone oils, fluorine modified surface active agents, and fluorine graft polymers.

As a surface treating agent having a radical polymerizable reactive group, it is preferable to use a silane coupling agent having an acryloyl group or a methacryloyl group.

Examples of a surface treating agent having a radical polymerizable reactive group as described above are as follows.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$

S-31

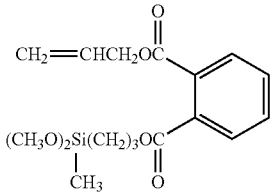

S-32

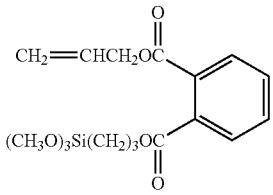

S-33

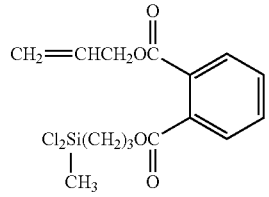

S-34

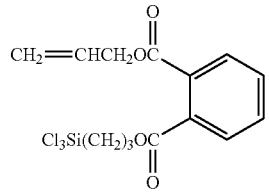

As a surface treating agent, in addition to the above-described compounds S-1 to S-34, it may be used other silane coupling agents having a reactive organic group that can conduct radical polymerization.

These surface treating agents may be used alone, or they may be used by mixing two or more kinds.

The used amount of the surface treating agent is not limited in particular. However, it preferably 0.1 to 100 mass parts with respect to 100 mass parts of the untreated metal oxide particles.

[Method for Surface Treatment of Metal Oxide Particles]

Specifically, the surface treatment of the metal oxide particles is done as follows. A slurry containing an untreated metal oxide particles and a specific surface treating agent (a suspension of solid particles) is pulverized in a wet state. The untreated metal oxide particles are made into minute particles, and at the same time, a surface treatment of the particles is made to proceed. Subsequently, the solvent is removed to obtain a substance in a powder state.

It is preferable that the slurry is a mixture containing: 0.1 to 100 mass parts of the surface treating agent; 50 to 5,000 mass parts of the solvent; and 100 mass parts of the untreated metal oxide particles.

As an apparatus used for wet pulverization of slurry, it may be cited a wet-media disperser.

The wet-media disperser has a container loaded with media beads and a stirring disk mounted vertically to a rotary shaft. The stirring disk rapidly spins to mill and disperse agglomerated particles of untreated metal oxide particles. It may be used any type of disperser which can sufficiently disperse the untreated metal oxide particles during the surface modification of the untreated metal oxide particles. Various types of dispersers may be used, such as a vertical type, a horizontal type, a continuous type, and a batch type.

Specific examples of a disperser include a sand mill, an Ultravisco mill, a pearl mill, a grain mill, a Dyno mill, an agitator mill, and a dynamic mill. Such a disperser pulverizes and disperses particles by impact cracking, friction, shear force, or shear stress provided by grinding media, such as balls and beads.

The beads used in the wet-media disperser may be spheres formed of, for example, glass, alumina, zircon, zirconia, steel, or flint. Particularly preferred beads are formed of zirconia or zircon. Although the diameter of the beads is usually about 1 to 2 mm, a preferred diameter is about 0.1 to 1.0 mm in the present invention.

The disk and the inner wall of the container of the wet-media disperser may be formed of any material, such as stainless steel, nylon, or ceramic. In the present invention, the disk and the inner wall of the container are preferably formed of a ceramic material, such as zirconia or silicon carbide.

(Charge Transporting Material)

A preferable charge transporting material contained in the protective layer is an electron transporting compound that does not react with a binder resin for a protective layer or metal oxide particles subjected to a surface treatment from the viewpoint of a hole transporting property.

As a charge transporting material, it may be used various kinds of known charge transporting materials. When UV rays are used for forming a protective film with a curing treatment, it is preferable to use a substance having no or small absorption at a short wavelength region of 450 nm or less.

A compounds represented by Formula (1) may be used as a charge transporting material having no or small absorption at a short wavelength region of 450 nm or less.

Formula (1)

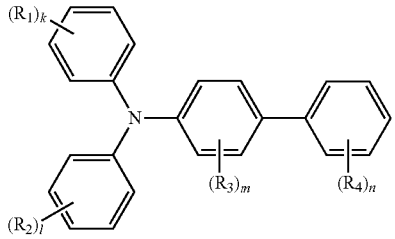

In Formula (1), $R_1$, $R_2$, $R_3$ and $R_4$ each respectively represent a hydrogen atom, an alkyl group of 1 to 7 carbon atoms, or an alkoxy group of 1 to 7 carbon atoms, k, 1, and n each respectively represent an integer of 1 to 5, and m represents an integer of 1 to 4. In the case that k, 1, m and n are 2 or more, a plurality of the groups may be the same or different with each other.

Exemplary compounds of a charge transporting material represented by Formula (1) are as follows (CTM-1 to CTM-22). However, the present invention is not limited to them.

| Compound | Structure | Molecular Weight |
|---|---|---|
| CTM-1 | 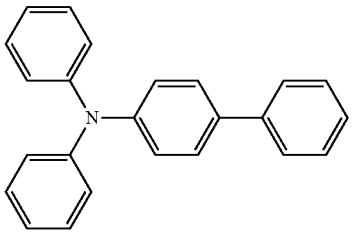 | 321.43 |
| CTM-2 | 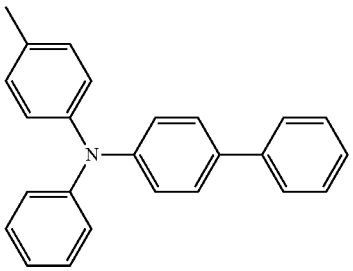 | 335.45 |
| CTM-3 | 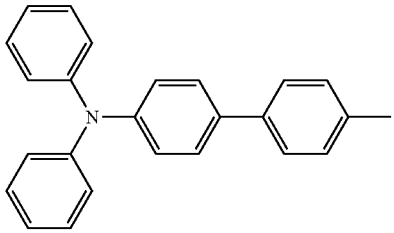 | 335.45 |

-continued
| Compound | Structure | Molecular Weight |
|---|---|---|
| CTM-4 | 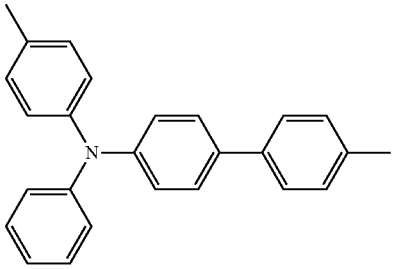 | 349.48 |
| CTM-5 | 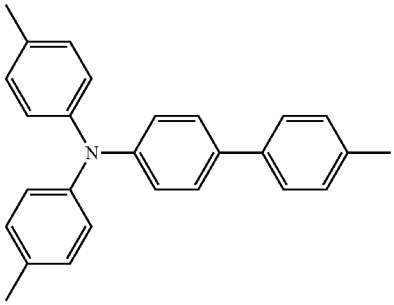 | 363.51 |
| CTM-6 | 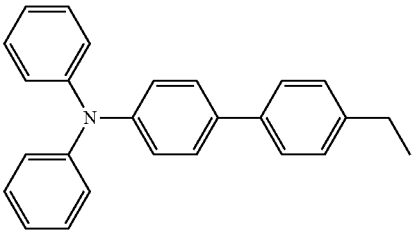 | 349.48 |
| CTM-7 | 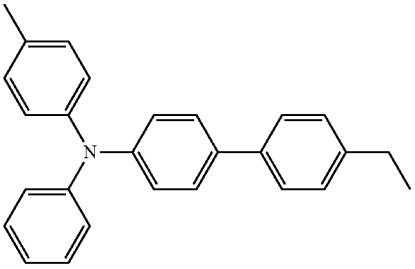 | 363.51 |
| CTM-8 | 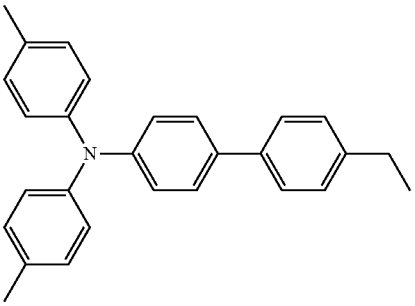 | 377.53 |

-continued
| Compound | Structure | Molecular Weight |
|---|---|---|
| CTM-9 | 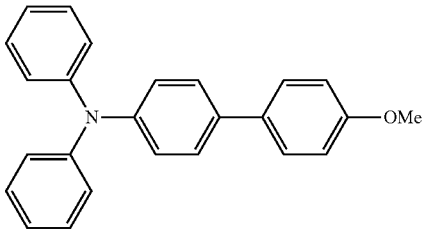 | 351.45 |
| CTM-10 | 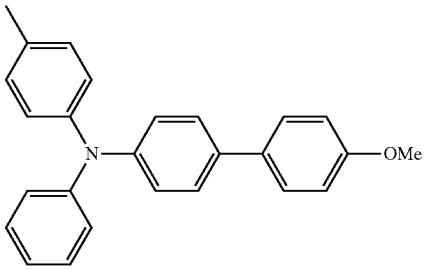 | 365.48 |
| CTM-11 | 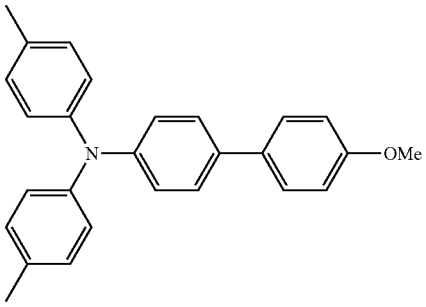 | 379.51 |
| CTM-12 | 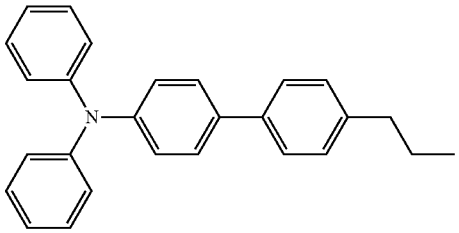 | 363.51 |
| CTM-13 | 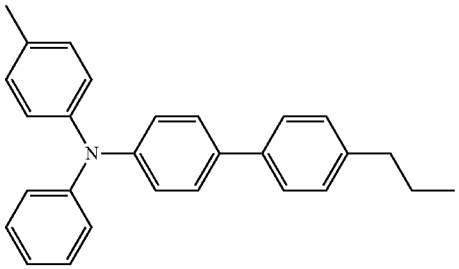 | 377.53 |

-continued
| Compound | Structure | Molecular Weight |
|---|---|---|
| CTM-14 | 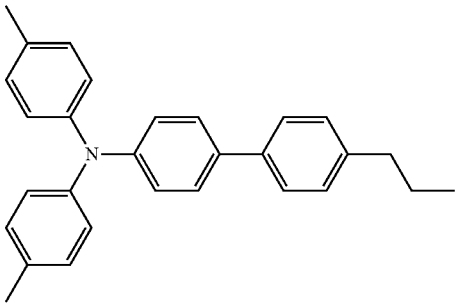 | 391.56 |
| CTM-15 | 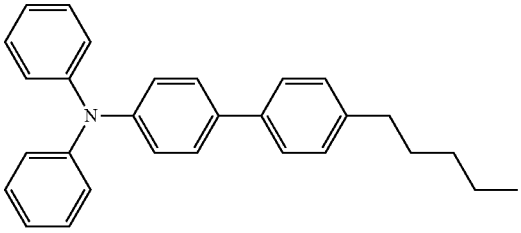 | 391.56 |
| CTM-16 | 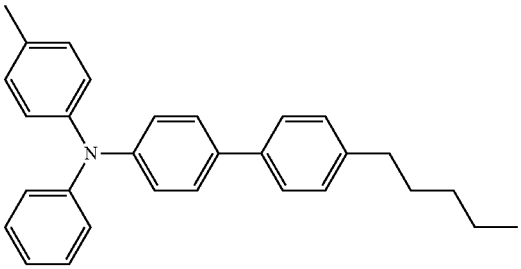 | 405.59 |
| CTM-17 | 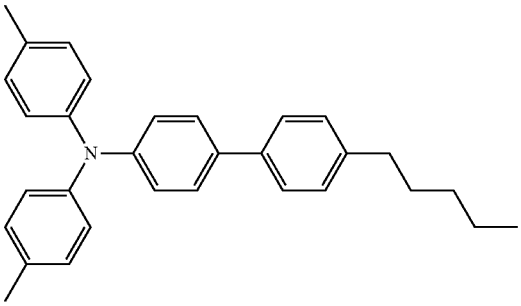 | 419.62 |
| CTM-18 | 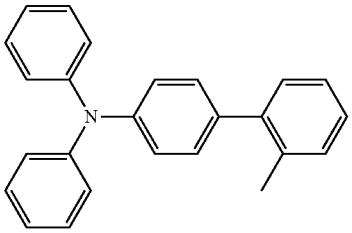 | 335.45 |

-continued

| Compound | Structure | Molecular Weight |
|---|---|---|
| CTM-19 | 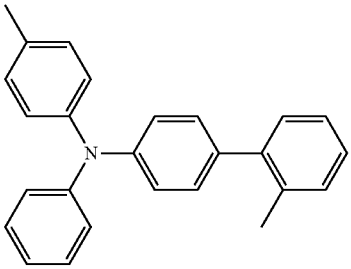 | 349.48 |
| CTM-20 | 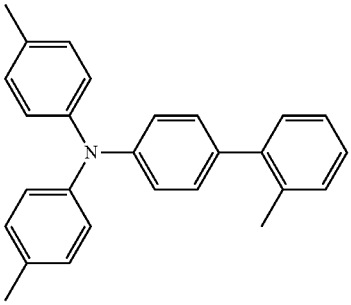 | 363.51 |
| CTM-21 | 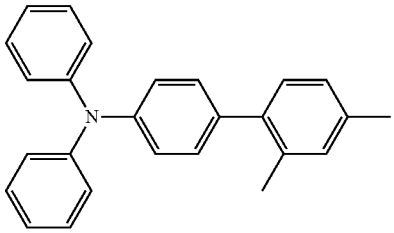 | 349.48 |
| CTM-22 | 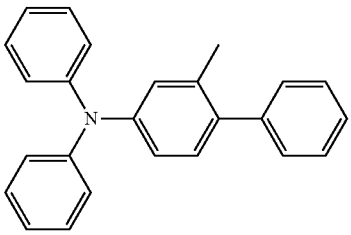 | 335.45 |

(Binder Resin for Protective Layer)

The binder resin for a protective layer is a cured resin prepared by polymerizing a polymerizable compound.

Preferably, the cured resin is a compound prepared by polymerizing a cross-linking polymerizable compound. Specifically, it is a compound produced with a compound having two or more radical polymerizable functional groups (hereafter, it is called as "a polymerizable compound having multi-functional radical functional groups") through irradiation with active rays such as UV rays or electron beams.

(Multi-Functional Radical Polymerizable Compound)

As a multi-functional radical polymerizable compound, since it is possible to cure the compound with a small amount of light with a short time, it is preferable to use an acrylic monomer or an acrylic oligomer each having two or more acryloyl groups ($CH_2{=}CHCO{-}$) or methacryloyl groups ($CH_2{=}CCH_3CO{-}$) as a radical polymerizable functional group.

Consequently, a preferable curable resin is an acrylic resin formed with an acrylic monomer or its oligomer.

Examples of a multi-functional radical polymerizable compound are as follows.

M1

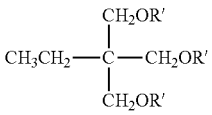

M2

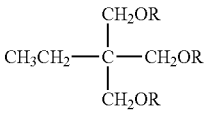

-continued

M3

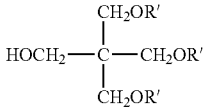

M4

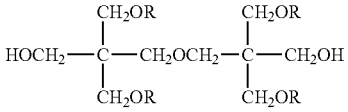

M5

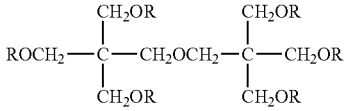

M6

$CH_3CH_2C(CH_2OC_3H_6OR)_3$

M7

$CH_3CH_2C(CH_2CH_2OR)_3$

M8

$R(OC_3H_6)_3OR$

M9

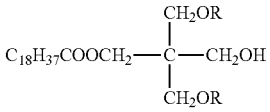

M10

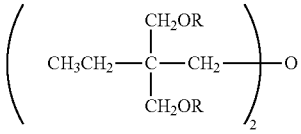

M11

$(ROCH_2)_4C$

M12

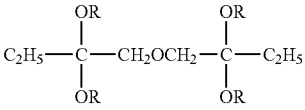

M13

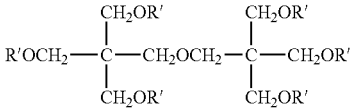

M14

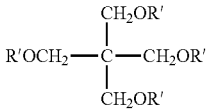

M15

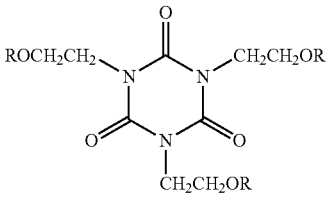

In the chemical formulas indicating the above-described exemplary compounds M1 to M15, R represents an acryloyl group ($CH_2$=CHCO—), and R' represents a methacryloyl group ($CH_2$=C($CH_3$)CO—).

As a binder resin for a protective layer, it may be added the following resins in addition to the above-described curable resin. Examples thereof are: polyvinyl butyral resins, epoxy resins, polyurethane resins, phenol resins, polyester resins, alkyd resins, polycarbonate resins, silicone resins, acrylic resins, melamine resins, and vinyl chloride-vinyl acetate copolymers. These may be used solely, or they may be used by combination of two or more kinds.

The protective layer may contain various types of lubricant particles or antioxidants when needed, in addition to the binder resin for a protective layer, the metal oxide particles, and the charge transporting material.

(Lubricant Particles)

It may be cited fluorine atom containing organic resin particles as lubricant particles. Examples of a resin for fluorine atom containing organic resin particles are: a tetrafluoro ethylene resin, a trifluoro chloro ethylene resin, a hexafluoro chloro ethylene propylene resin, a vinyl fluoride resin, a vinylidene fluoride resin, a difluoro dichloro ethylene resin and copolymers thereof. These may be used solely, or they may be used in combination of two or more kinds. Among them, preferable resins are: a tetrafluoro ethylene resin and a vinylidene fluoride resin.

A number average primary particle size of the lubricant particles is preferably 0.01 to 1 μm, and more preferably, it is 0.05 to 0.5 μm.

The lubricant particles are preferably contained in an amount of 5 to 70 mass parts with respect to 100 mass parts of the binder resin for a protective layer. More preferably, they are contained in an amount of 10 to 60 mass parts.

A thickness of the protective layer is preferably 0.2 to 10 μm, more preferably it is 0.5 to 6 μm.

(Forming Method of Protective Layer]

A protective layer may be formed with the following. A coating liquid is prepared by dissolving or dispersing the following in a solvent: a multi-functional radical polymerizable compound, metal oxide particles, a charge transporting material, and a known resin, a polymerization initiator, lubricant particles, or an antioxidant when needed. The prepared coating liquid is applied on the surface of the charge transporting layer to form a coating film. Then, it is cured to obtain a protective layer.

[Polymerization Initiator]

As a method of making a polymerization reaction of a multi-functional radical polymerizable compound, it may be used a method of using a cleaving reaction with electron beams, or a method of using heat or light under the existence of a radical polymerization initiator.

A polymerization initiator which may be incorporated in the protective layer is a radical polymerization initiator enabling to start polymerization of a multi-functional radical polymerizable compound. A heat polymerization initiator and a photo polymerization initiator may be cited. It is preferable to use a photo polymerization initiator.

Examples of a photopolymerization initiator include: acetophenone and ketal initiators, such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 (Irgacure 369, manufactured by BASF Japan Ltd.), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime; benzoin ether initiators such as benzoin, benzoin methyl ether, benzoin ethyl ether, benzoin isobutyl ether, and benzoin isopropyl ether; benzophenone initiators such as benzophenone, 4-hydroxybenzophenone, o-benzoyl methyl benzoate, 2-benzoylnaphthalene, 4-benzoylbiphenyl, 4-benzoyl phenyl ether, acrylated benzophenone, and 1,4-benzoylbenzene; and thioxanthone initiators such as 2-isopropylthioxanthone, 2-chlorothioxanthone, 2,4-dimethylthioxanthone, 2,4-diethylthioxanthone, and 2,4-dichlorothioxanthone.

Other photopolymerization initiators include: ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide (Irgacure 819, manufactured by BASF Japan Ltd.), bis(2,4-dimethoxybenzoyl)-2,4,4-trimethylpentylphosphine oxide, methylphenylglyoxyester, 9,10-phenanthrene, acridine compounds, triazine compounds, and imidazole compounds.

A compound having a photopolymerization promoting effect may be used alone or in combination with any of the aforementioned photopolymerization initiators. Examples of a compound having a photopolymerization promoting effect include: triethanolamine, methyldiethanolamine, 4-dimethylaminoethyl benzoate, 4-dimethylaminoisoamyl benzoate, (2-dimethylamino)ethyl benzoate, and 4,4'-dimethylaminobenzophenone.

These polymerization initiators may be used alone or in combination of two or more kinds. The polymerization initiator is usually used in an amount of 0.1 to 20 mass parts, preferably 0.5 to 10 mass parts, relative to 100 mass parts of the multi-functional radical polymerizable compound.

[Solvent]

Examples of a solvent used for formation of the surface layer include: methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, and diethylamine. However, the present invention is not limited to them.

These solvents may be used alone, or they may be used by mixing two or more kinds.

As a dispersion method of metal oxide particles or lubricant particles, it may be cited the same method as used for dispersing the rutile type titanium oxide particles for a coating liquid for an intermediate layer.

As a coating method of the coating liquid for a protective layer, it may be cited the same method as used for the coating method of the coating liquid for an intermediate layer. In order to prevent dissolution of a binder resin for a photosensitive layer as much as possible, it is preferable to use a spray coating method or a slide hopper method. It is more preferable to use a slide hopper method using a circular slide hopper coating apparatus.

In the curing treatment, it is preferable to make polymerization via generation of a radical by irradiating the coated layer with active rays, and to cure with forming a cross-linking bond by cross-linking reaction of intra and inter molecules, to result in forming a binder resin for a surface layer. As the active rays, it is preferable to use lights such as UV rays, or visible rays, or electron beams. In view of the easy handling, the use of UV rays is particularly preferable.

Examples of a UV source include: a low-pressure mercury lamp, a middle-pressure mercury lamp, a high-pressure mercury lamp, an ultrahigh-pressure mercury lamp, a carbon-arc lamp, a metal halide lamp, a xenon lamp, a flash (pulsed) xenon lamp, and a UV LED. The conditions of emitting actinic rays may vary depending on the type of the lamp. The dose of actinic rays is usually 5 to 500 mJ/cm$^2$, preferably it is 5 to 100 mJ/cm$^2$. The output power of the light source is preferably 0.1 to 5 kW, particularly preferably, it is 0.5 to 3 kW.

A curtain beam-type electron beam emitting device is preferably used as an electron beam source. The accelerating voltage during emission of electron beams is preferably 100 to 300 kV. The absorbed dose is preferably 0.5 to 10 Mrad.

An only requirement of an irradiation time of the active rays is to obtain a necessary amount of irradiation of the active rays. Specifically, the irradiation time is preferably 0.1 seconds to 10 minutes. From the viewpoint of curing efficiency or operation efficiency, more preferable time is 0.1 seconds to 5 minutes.

The coating film may be subjected to a drying treatment before or after, or during the irradiation with active rays. The timing to perform the drying treatment may be suitably selected by combining the irradiating conditions of active rays. The drying conditions of the surface layer are suitably selected depending on the kind of solvent used in the coating liquid or the thickness of the surface layer. The drying temperature is preferably room temperature to 180° C., more preferably, it is 80 to 140° C. The drying time is preferably 1 to 200 minutes, more preferably, it is 5 to 100 minutes.

[Image-Forming Apparatus]

The image-forming apparatus of the present invention is an image-forming apparatus employing a common electrophotographic method. For example, the image-forming apparatus of the present invention includes: a photoreceptor of the present invention; a charging unit to charge a surface of the photoreceptor; an exposing unit to form an electrostatic latent image on the surface of the photoreceptor; a developing unit to develop the electrostatic latent image with a toner into a toner image; a transferring unit to transfer the toner image on a transfer medium; a fixing unit to fix the transferred toner image; and a cleaning unit to remove the residual toner on the photoreceptor.

Figure 2:
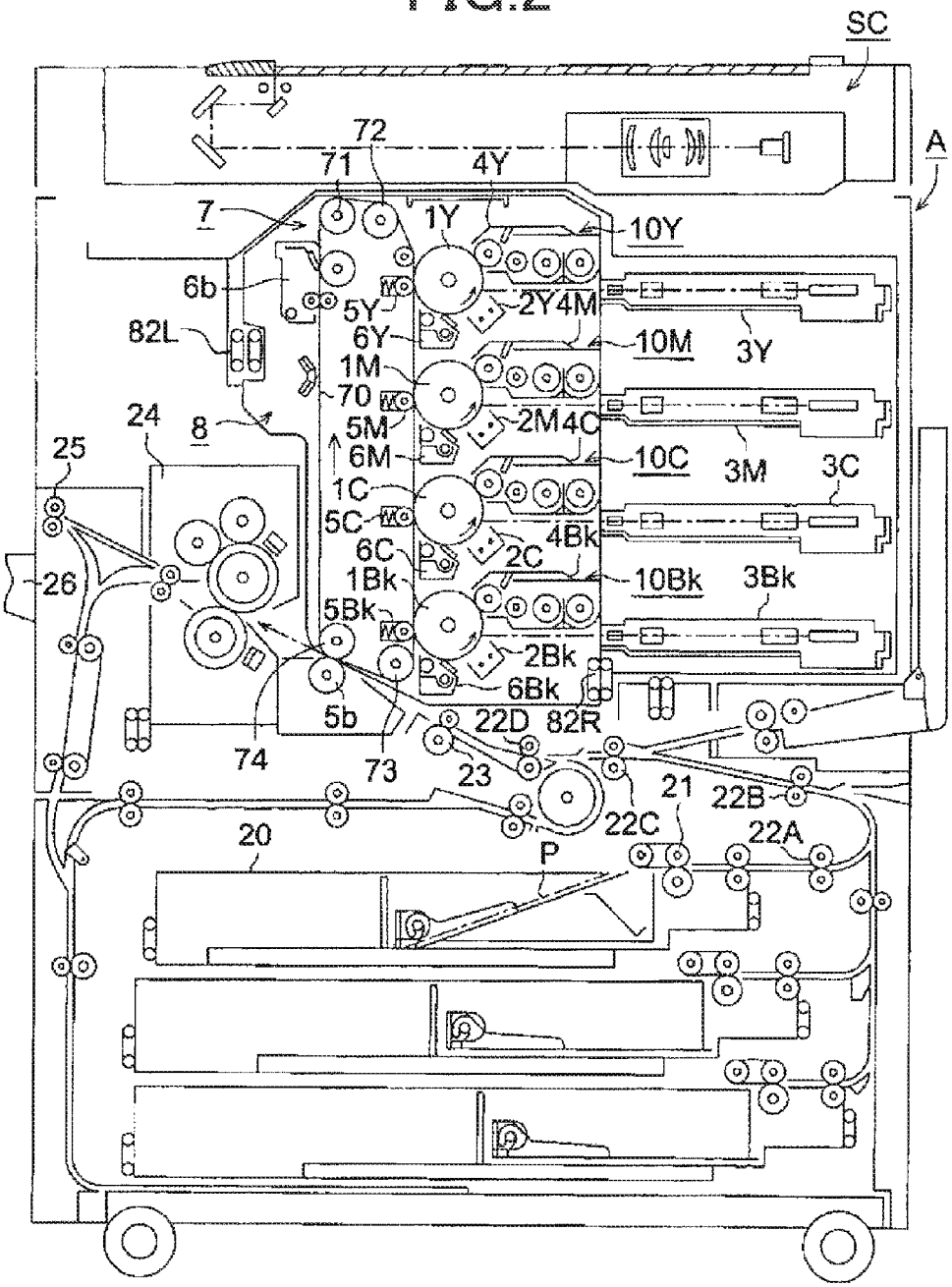
FIG. 2 is a schematic constitution of an image-forming apparatus provided with an electrophotographic photoreceptor of the present invention.

FIG. 2 is a cross-sectional view to illustrate a schematic constitution of an image-forming apparatus provided with a photoreceptor of the present invention.

This image-forming apparatus is called as a tandem color image-forming apparatus, and it includes four image forming sections (image-forming units) 10Y, 10M, 10C, and 10Bk, an endless belt form intermediate transferring unit 7, a sheet feeding unit 21, and a fixing unit 24. The image-forming apparatus further includes a document scanner SC above a body A of the image-forming apparatus.

The four image-forming units 10Y, 10M, 10C, and 10Bk each respectively include: the photoreceptors 1Y, 1M, 1C, and 1Bk at the center, the charging units 2Y, 2M, 2C, and 2Bk, the exposing units 3Y, 3M, 3C, and 3Bk, the developing units 4Y, 4M, 4C, and 4Bk, and the cleaning units 6Y, 6M, 6C, and 6Bk for cleaning the photoreceptors 1Y, 1M, 1C, and 1Bk located around the photoreceptors.

The image-forming apparatus of the present invention employs at least one of the above-described photoreceptors of the present invention as the photoreceptors 1Y, 1M, 1C, and 1Bk.

The image-forming units 10Y, 10M, 10C, and 10Bk have the same configuration except for the colors (yellow, magenta, cyan and black) of toner images formed on the photoreceptors 1Y, 1M, 1C, and 1Bk. Thus, the following description focuses on the image-forming unit 10Y as an example.

The image-forming unit 10Y includes the charging unit 2Y, the exposing unit 3Y, the developing unit 4Y, and the cleaning unit 6Y, which are disposed around the photoreceptor 1Y (image retainer). The image-forming unit 10Y forms a yellow (Y) toner image on the photoreceptor 1Y.

The charging unit 2Y provides the photoreceptor 1Y with a uniform electric potential. In the present embodiment, as a charging unit, it can be cited a contact type roller charger or a non-contact type roller charger.

The exposing unit 3Y exposes the photoreceptor 1Y provided with the uniform potential by the charging unit 2Y in response to image signals (yellow) to form an electrostatic latent image corresponding to the yellow image. The exposing unit 3Y includes light-emitting devices (LEDs) arrayed in the axial direction of the photoreceptor 1Y and an imaging element, or includes a laser optical device.

The developing unit 4Y is composed of: a developing sleeve which includes a magnet and rotates with holding a developer; and a voltage applying device to apply a DC or AC bias voltage between the photoreceptor 1Y and this developing sleeve.

As a fixing unit 24, it can be cited a heat-roller type fixing device composed of: a heat roller incorporating a heat source inside thereof; and a pressure roller which forms a nip portion at the heat roller in such a manner to abut the heat roller.

The cleaning unit 6Y is composed of: a cleaning blade; and a brush roller located in the upstream side of the cleaning blade, for example.

In the image-forming apparatus of FIG. 2, among the image-forming unit 10Y, the photoreceptor 1Y, the developing unit 2Y, and the cleaning unit 6Y may be integrated into a processing cartridge. The processing cartridge may be detachably provided on the body A of the image-forming apparatus via a guiding device such as a rail.

The image-forming units 10Y, 10M, 10C, and 10Bk are aligned in the vertical direction. The endless belt form intermediate transferring unit 7 is disposed on the left of the photoreceptors 1Y, 1M, 1C, and 1Bk in FIG. 2.

The endless belt form intermediate transferring unit 7 includes: the intermediate transferring belt 70 of semiconductor in an endless belt form that are rotatably wound around the first transferring rollers 5Y, 5M, 5C, and 5Bk, the second transfer roller 5*b*, and a plurality of rollers 71, 72, 73, and 74; and the cleaning unit 6*b*.

The image-forming units 10Y, 10M, 10C, and 10Bk, and the endless belt form intermediate transferring unit 7 are accommodated in a housing 8. The housing 8 has a structure which can be drawn from the apparatus body A via rails 82L and 82R.

During the image-forming treatment, the first transferring roller 5Bk abuts the photoreceptor 1Bk all the time. The first transferring rollers 5Y, 5M, and 5C abut the respective photoreceptors 1Y, 1M, and 1C only during the formation of a color image.

The second transferring roller 5*b* abuts the intermediate transferring belt 70 in an endless belt form only during passage of the transfer material P therebetween for conducting the second transferring operation.

In the image-forming apparatus of FIG. 2, the image-forming apparatus is illustrated as a color laser printer. However, the photoreceptor of the present invention may be applied similarly to a monochromatic laser printer, or a copier. Further, in this image-forming apparatus, a light source other than a laser, such as an LED light source, may be used as an exposing light source.

In the image-forming apparatus as described above, an image-forming process is carried out in the following way.

The color images are formed by the image-forming units 10Y, 10M, 10C, and 10Bk. The formed images are sequentially transferred onto the rotating endless belt form intermediate transferring belt 70 with the respective first transferring rollers 5Y, 5M, 5C, and 5Bk, to form a synthesized color image.

A transfer medium P (an image retainer to retain a fixed final image; e.g., a plain paper or a transparent sheet) accommodated in a sheet feeding cassette 20 is fed by the sheet feeding unit 21, and is transported to a second transferring roller 5*b* via multiple intermediate rollers 22A, 22B, 22C, and 22D and register rollers 23. The color image is transferred at once onto the transfer medium P. The color image transferred on the transfer medium P is fixed by the fixing unit 24. The transfer medium P is then pinched between discharging rollers 25 and is conveyed to a sheet receiving tray 26 provided outside of the apparatus.

On the other hand, after transferring the color image onto the transfer material P with the second transferring roller 5*b* and after conducting the curved separation of the transfer material P from the intermediate transferring belt 70, the residual toner on the intermediate transferring belt 70 in an endless belt form is removed by the cleaning unit 6*b*.

(Toner and Developer)

A toner used for an image-forming apparatus as described above may be a pulverized toner or a polymerized toner. In an image-forming apparatus according to the present invention, a polymerized toner prepared with a polymerization method is preferably employed from the viewpoint of obtaining an image of high quality.

A polymerized toner designates a toner which is prepared in such a manner that formation of the binder resin and the formation of the toner particles, both being elements constituting the toner, are done simultaneously. That is, the polymerization of the raw material monomer to obtain the binder resin and the chemical treatment to the binder resin when required are done side by side.

More specifically, a polymerized toner is a toner obtained by the step of producing resin particles via polymerization reaction such as suspension polymerization or emulsion polymerization; and by the step of fusing the produced resin particles done afterward when needed.

As a toner used for an image-forming apparatus of the present invention, it is preferable to use a toner containing a binder resin made of a crystalline resin. By using a toner containing a binder resin made of a crystalline resin, generation of fog can be prevented in the produced image. This is supposed to be resulted from the decrease of charge variation when the toner is triboelectric-charged in the developing units 4Y, 4M, 4C, and 4Bk.

A volume average particle size of the toner, namely the 50% volume particle size (Dv50), is preferably 2 to 9 μm, more preferably, it is 3 to 7 μm. By making the size of the toner to be in this range, the resolution of the image can be increased. Further, by making the size of the toner to be in this range, the prepared toner may decrease the amount of the toner having a fine particle size while keeping a small particle size. As a result, the dot image reproduction property may be improved over a long period of time, and the toner can form an image of high resolution and high stability.

The toner according to the present invention may be used as a mono-component developer by using singly, or may be used as a two-component developer by mixing with a carrier.

When the toner is used as a mono-component developer, it may be used as a non-magnetic mono-component developer, or a magnetic mono-component developer with incorporating magnetic particles having a size of about 0.1 to 0.5 μm in the toner. These developers may be used.

When the toner is used as a two-component developer by mixing with a carrier, the known materials may be used for the magnetic particles as a carrier. Examples thereof are: metals such as iron, ferrite, and magnetite; and alloys with these metals with aluminum or lead. Among them, ferrite particles are particularly preferable. It is preferable that the above-described magnetic particles have a volume average particle size of 15 to 100 μm, more preferably, it is 25 to 80 μm.

The measurement of the volume average particle size of the carrier can be done, for example, with a laser diffraction particle distribution apparatus "HELOS" provided with a wet dispersion device (made by SYMPATEC Co. Ltd.).

A preferable carrier is made of magnetic particles covered with a resin, or so-called a resin dispersion type carrier made of magnetic particles dispersed in a resin. Although a resin component for coating the magnetic particles is not specifically limited, examples of a usable resin are: olefin resins, styrene resins, styrene-acrylic resins, silicone resins, ester resins, and fluorinated polymer resins. As a resin for constituting the resin dispersion type carrier, known resins can be used without any limitation. Examples of the usable resin are: styrene-acrylic resins, polyester resins, fluoro-resins, and phenol resins.

As stated above, the specific embodiments of the present invention were described. However, the embodiments of the present invention are not limited to them, and various modifications can be made to them.

EXAMPLES

Specific examples of the present invention will be described in the following. However, the present invention is not limited to them.

The chemical structures of the compounds used in Examples are indicated in the following.

tCTM-1

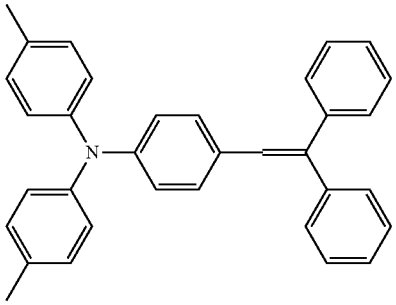

tCTM-2

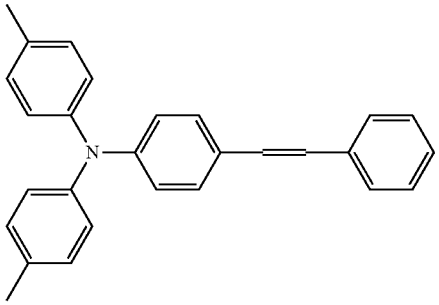

tCTM-3

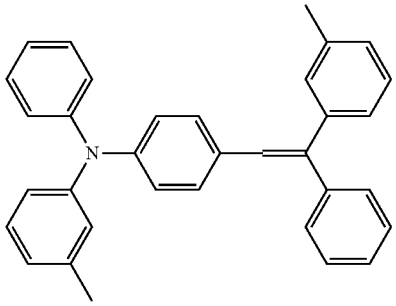

tCTM-4

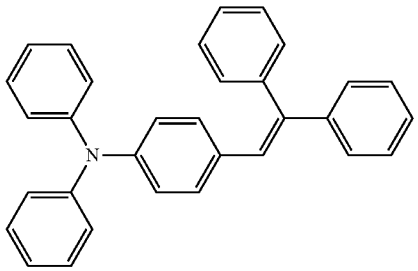

tCTM-5

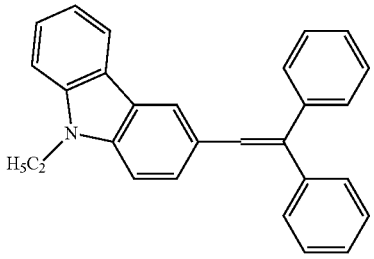

-continued
tCTM-6
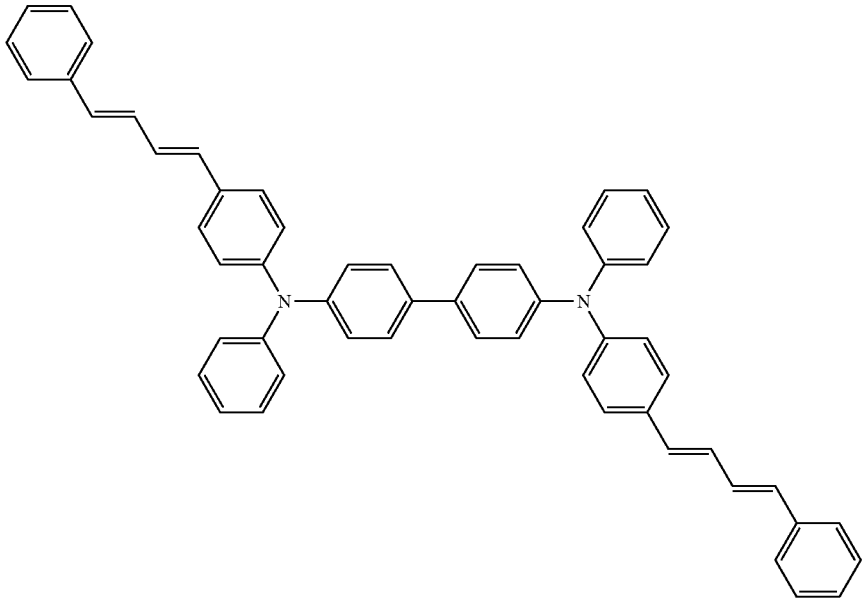
tCTM-7
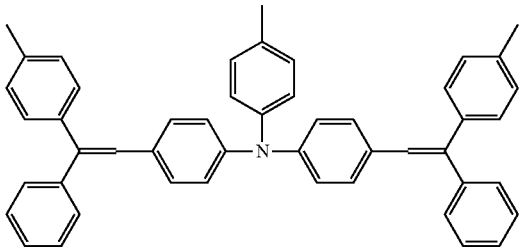
tCTM-8
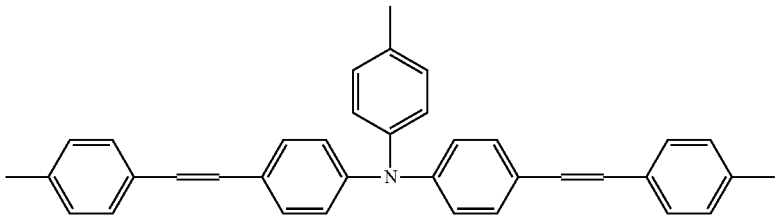
pCTM-1
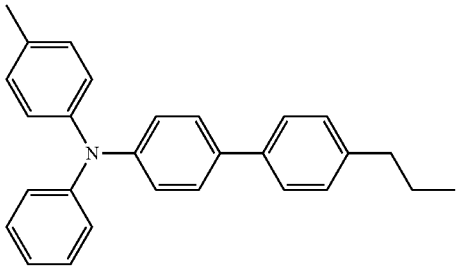
N-1
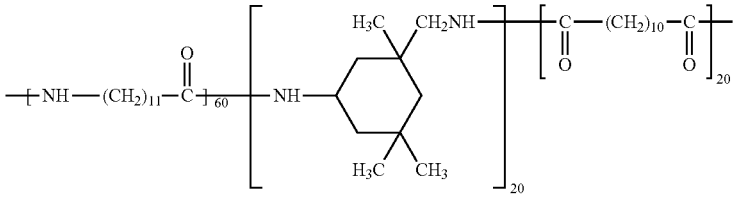

[Preparation of Titanium Oxide Particles]

According to Examples 1 to 8 of surface treatment of titanium oxide particles as described in the following, there were prepared Titanium oxide particles (1) to (8) included in the intermediate layer of Photoreceptors (1) to (16).

Example 1 of Surface Treatment of Titanium Oxide Particles 500 mass parts of rutile type titanium oxide particles having a number average particle size of 15 nm, 30 mass parts of methyl hydrogen polysiloxane (MHPS) made by Shin-Etsu Chemical Co. Ltd. as a surface treating agent, and 1, 300 mass parts of toluene were mixed with stirring. Then, the mixture was subjected to a wet pulverization treatment for 40 minutes in the mill at a temperature of 35° C. by using a bead mill. Toluene was separated and removed from the obtained slurry by distillation under a reduced pressure. The obtained dry substance was heated at 120° C. for 2 hours. Thus, baking of the surface treating agent was carried out. Subsequently, by pulverizing with a pin mill, the rutile type titanium oxide particles (1) subjected to an organic treatment were prepared.

Example 2 of Surface Treatment of Titanium Oxide Particles

The rutile type titanium oxide particles (2) subjected to an organic treatment were prepared in the same manner as Example 1 of surface treatment of titanium oxide particles, except that 100 mass parts of 3-methacryloxypropyl trimethoxy silane "KBM-503" (made by Shin-Etsu Chemical Co. Ltd.) were used instead of 30 mass parts of methyl hydrogen polysiloxane (MHPS) as a surface treating agent.

Example 3 of Surface Treatment of Titanium Oxide Particles 500 mass parts of rutile type titanium oxide particles having a number average particle size of 35 nm and 2,000 mass parts of toluene were mixed with stirring. Then, 13 mass parts of methyl hydrogen polysiloxane (MHPS) made by Shin-Etsu Chemical Co. Ltd were added as a surface treating agent, and the mixture was stirred at 50° C. for 3 hours. Subsequently, toluene was removed under a reduced pressure, and the residue was heated at 130° C. for 3 hours. Thus, baking of the surface treating agent was carried out. Subsequently, by pulverizing with a pin mill, the rutile type titanium oxide particles (3) subjected to an organic treatment were prepared.

Example 4 of Surface Treatment of Titanium Oxide Particles

The rutile type titanium oxide particles (4) subjected to an organic treatment were prepared in the same manner as Example 3 of surface treatment of titanium oxide particles, except that 65 mass parts of 3-acryloxypropyl trimethoxy silane "KBM-5103" (made by Shin-Etsu Chemical Co. Ltd.) were used instead of 30 mass parts of methyl hydrogen polysiloxane (MHPS) as a surface treating agent.

Example 5 of Surface Treatment of Titanium Oxide Particles 500 mass parts of titanium oxide particles subjected to an inorganic treatment obtained by a silica treatment to rutile type titanium oxide particles having a number average particle size of 35 nm, 40 mass parts of methyl hydrogen polysiloxane (MHPS) made by Shin-Etsu Chemical Co. Ltd. as a surface treating agent, and 1, 800 mass parts of toluene were mixed with stirring. Then, the mixture was subjected to a wet pulverization treatment for 60 minutes in a mill at a temperature of 35° C. by using a bead mill. Toluene was separated and removed from the obtained slurry by distillation under a reduced pressure. The obtained dry substance was heated at 120° C. for 2 hours. Thus, baking of the surface treating agent was carried out. Subsequently, by pulverizing with a pin mill, the rutile type titanium oxide particles (5) subjected to an organic treatment after subjected to an inorganic treatment were prepared.

Example 6 of Surface Treatment of Titanium Oxide Particles 500 mass parts of titanium oxide particles "MT-500SA" (made by Teika Co. Ltd.) subjected to an inorganic treatment obtained by a silica treatment and an alumina treatment to rutile type titanium oxide particles having a number average particle size of 35 nm, 13 mass parts of methyl hydrogen polysiloxane (MHPS) "KF 9901" made by Shin-Etsu Chemical Co. Ltd. as a surface treating agent, and 1, 500 mass parts of toluene were mixed with stirring. Then, the mixture was subjected to a wet pulverization treatment for 25 minutes in a mill at a temperature of 35° C. by using a bead mill. Toluene was separated and removed from the obtained slurry by distillation under a reduced pressure. The obtained dry substance was heated at 120° C. for 2 hours. Thus, baking of the surface treating agent was carried out. Subsequently, by pulverizing with a pin mill, the rutile type titanium oxide particles (6) subjected to an organic treatment after subjected to an inorganic treatment were prepared.

Example 7 of Surface Treatment of Titanium Oxide Particles 500 mass parts of anatase type titanium oxide particles having a number average particle size of 30 nm, 15 mass parts of methyl hydrogen polysiloxane (MHPS) made by Shin-Etsu Chemical Co. Ltd. as a surface treating agent, and 1, 800 mass parts of toluene were mixed with stirring. Then, the mixture was subjected to a wet pulverization treatment for 60 minutes in a mill at a temperature of 35° C. by using a bead mill. Toluene was separated and removed from the obtained slurry by distillation under a reduced pressure. The obtained dry substance was heated at 120° C. for 2 hours. Thus, baking of the surface treating agent was carried out. Subsequently, by pulverizing with a pin mill, the anatase type titanium oxide particles (7) subjected to an organic treatment were prepared.

Example 8 of Surface Treatment of Titanium Oxide Particles 500 mass parts of titanium oxide particles subjected to an inorganic treatment (made by Teika Co. Ltd.) obtained by a silica treatment to anatase type titanium oxide particles having a number average particle size of 30 nm, 40 mass parts of methyl hydrogen polysiloxane (MHPS) made by Shin-Etsu Chemical Co. Ltd. as a surface treating agent, and 1, 800 mass parts of toluene were mixed with stirring. Then, the mixture was subjected to a wet pulverization treatment for 60 minutes in a mill at a temperature of 35° C. by using a bead mill. Toluene was separated and removed from the obtained slurry by distillation under a reduced pressure. The obtained dry substance was heated at 120° C. for 2 hours. Thus, baking of the surface treating agent was carried out. Subsequently, by pulverizing with a pin mill, the anatase type titanium oxide particles (8) subjected to an inorganic treatment were prepared.

With respect to the prepared titanium oxide particles as described above, there are listed in Table 1: crystal type; particle size; and conditions of inorganic treatment and organic treatment.

TABLE 1

| Titanium oxide particle No. | Crystal type | Particle size (nm) | Inorganic treatment | Organic treatment |
|---|---|---|---|---|
| (1) | Rutile | 15 | — | MHPS |
| (2) | Rutile | 15 | — | KBM-503 |
| (3) | Rutile | 35 | — | MHPS |
| (4) | Rutile | 35 | — | KBM-5103 |
| (5) | Rutile | 35 | Silica | MHPS |
| (6) | Rutile | 35 | Silica, Alumina | MHPS |
| (7) | Anatase | 30 | — | MHPS |
| (8) | Anatase | 30 | Silica | MHPS |

[Preparation of Photoreceptor (1)]

(1) Preparation of Conductive Support

A conductive support (1) having a fine coarse surface was prepared through milling of the surface of a cylindrical aluminum support having a diameter of 60 mm.

(2) Formation of Intermediate Layer

An intermediate layer 1 was prepared as follows.

100 mass parts of polyamide resin "N-1" were added to 1,850 mass parts of mixed solvent composed of ethanol/n-propyl alcohol/tetrahydrofuran (volume ratio: 50/20/30). The mixture was stirred at 20° C. To this solution were added 320 mass parts of the rutile type titanium oxide particles (1) and dispersed for 2 hours in a mill by a bead mill. The mixture was left still for one day, then, it was filtered using Rigimesh™ 5 μm filter (made by Japan Pore Co. Ltd.) with a pressure of 50 kPa. Thus a coating liquid (1) for forming an intermediate layer was obtained.

Thus obtained coating dispersion for forming an intermediate layer was applied to the outer surface of the washed conductive support (1). Subsequently, the coated layer was dried at 120° C. for 30 minutes to obtain an intermediate layer (1) having a dry thickness of 2 μm.

(3) Formation of Charge Generating Layer (3-1) Preparation of Charge Generating Material 29.2 mass parts of 1,3-diiminoisoindoline were dispersed in 200 mass parts of o-dichlorobenzene. Then, 20.4 mass parts of titanium tetra-n-butoxide were added. Subsequently, the mixture was heated at 150 to 160° C. under a nitrogen atmosphere for 5 hours. After cooling the mixture, precipitated crystals were filtered. Then the crystals were washed successively with chloroform, 2% aqueous hydrochloric solution, water, and methanol, and then they were dried. Thus, 26.2 mass parts (yield: 91%) of crude titanyl phthalocyanine were obtained.

Subsequently, the crude titanyl phthalocyanine was dissolved in 250 mass parts of concentrated sulfuric acid at 5° C. or less by stirring for 1 hour. The solution was poured into 5,000 mass parts of water at 20° C. The precipitated crystals were filtered and washed with water to obtain 225 mass parts of wet past product. This wet past product was frozen in a refrigerator. After defrosting the product, it was again filtered and dried to obtain 24.8 mass parts (yield: 86%) of amorphous titanyl phthalocyanine.

10.0 mass parts of the amorphous titanyl phthalocyanine and 0.94 mass parts (0.6 mole equivalent ratio with respect to the titanyl phthalocyanine, the same hereinafter) of (2R,3R)-2,3-butanediol were added to 200 mass parts of o-dichlorobenzene (ODB). The mixture was heated with stirring at 60 to 70° C. for 6.0 hours. After left still for one night, methanol was added to the mixture. The produced crystals were filtered and washed with methanol to obtain 10.3 mass parts of charge generating material (CG-1) containing a pigment of a (2R,3R)-2,3-butanediol adduct of titanyl phthalocyanine. In an X-ray diffraction spectrum of the charge generating material (CG-1), there appeared distinct peaks at 8.3°, 24.7°, 25.1°, and 26.5°. In its mass spectrum, there appeared peaks at 576 and 648. In its IR spectrum, there appeared absorption peaks at about 970 $cm^{-1}$ of Ti═O, and at about 630 $cm^{-1}$ of O—Ti—O. Further, in a thermal analysis (TG), there was observed about 7% of mass reduction at 390 to 410° C. Based on the above observations, the produced charge generating material (CG-1) was estimated to be a mixture composed of:

a 1:1 adduct of titanyl phthalocyanine and (2R,3R)-2,3-butanediol, and a non-adduct (not forming an adduct) of titanyl phthalocyanine.

(3-2) Preparation of Coating Liquid (1) for Charge Generating Layer

A coating liquid (1) for a charge generating layer was prepared through mixing of the following materials using a circulating ultrasonic homogenizer "RUS-600TCVP" (made by Nippon Seiki, Co. Ltd.: 19.5 kHz, 600 W) with a circulating amount of 40 L/H.

Charge generating material (CG-1) 24 mass parts

Polyvinyl butyral resin "S-LEC BL-1" (made by Sekisui Chemical, Co. Ltd.) 12 mass parts Solvent: Methyl ethyl ketone/cyclohexanone=4/1 (V/V) 600 mass parts (3-3) Formation of Charge Generating Layer The above-described coating liquid (1) was applied onto the above-described intermediate layer (1) with a dip coating method, and the resultant coating film was dried to form a charge generating layer (1) having a thickness of 0.5 μm.

(4) Formation of Charge Transporting Layer

A coating liquid (1) for a charge transporting layer was prepared through mixing and dissolution of the following materials.

| | |
|---|---|
| Charge transporting material: a compound named as tCTM-1 | 225 mass parts |
| Binder resin for charge transporting layer: polycarbonate resin "Z300" (made by Mitsubishi Gas Chemical Co. Inc.) | 300 mass parts |
| Antioxidant: "Irganox 1010" (made by BASF Japan Co.) | 6 mass parts |
| Solvent: Tetrahydrofuran | 1,600 mass parts |
| Solvent: Toluene | 400 mass parts |
| Silicone oil "KF-50" (made by Shin-Etsu Chemical Co., Ltd.) | 1 mass part |

The coating liquid (1) for a charge transporting layer was applied onto the charge generating layer (1) using a circular slide hopper coating apparatus and the resultant film was dried to form a charge transporting layer (1) having a thickness of 20 μm.

(5) Formation of Protective Layer (5-1) Preparation of Metal Oxide Particles

Tin oxide particles (1) were prepared as follows.

100 mass parts of untreated tin oxide particles (made by C. I. Kasei Co. Ltd., number average particle size: 20 nm;

volume resistance: 1.05×105 (Ω·cm), 30 mass parts of surface treating agent "S-15" (the above exemplified compound), and 300 mass parts of mixed solvent (toluene/isopropyl alcohol=1/1 mass ratio) were mixed. The mixture was put into a sand mill with zirconia beads. It was stirred at about 40° C. with a rotation rate of 1,500 rpm to perform a surface treatment. The mixture having been subjected to the surface treatment was taken out. The mixture was put into a Henschel mixer, and it was stirred with a rotation rate of 1,500 rpm for 15 minutes. After drying the mixture at 120° C. for 3 hours, tin oxide particles (1) were prepared.

(5-2) Formation of Protective Layer

A coating liquid (1) for a protective layer was prepared by mixing and stirring the coating composition of the following materials to achieve a sufficiently dissolving and dispersing state.

| | |
|---|---|
| Metal oxide particles: Tin oxide particles (1) | 105 mass parts |
| Polymerizable compound: Methacrylate monomer "SR350" (made by Nippon Kayaku, Co. Ltd.) | 100 mass parts |
| Charge transporting material: Compound "pCTM-1" | 12 mass parts |
| Polymerization initiator: "Irgacure 184" (made by BASF Japan Co.) | 5 mass parts |
| Radical trapping agent: "Smilizer GS" (made by Sumitomo Chemical, Co. Ltd.) | 5 mass parts |
| Solvent: 2-Butanol | 320 mass parts |
| Solvent: Tetrahydrofuran | 80 mass parts |

The coating liquid (1) for a protective layer was applied onto the charge transporting layer (1) using a circular slide hopper coating apparatus. The resultant coating film was dried with a metal halide lamp to irradiate UV rays for 1 minute to form a protective layer (1) having a dry thickness of 3.0 μm. Thus, a photoreceptor (1) was prepared.

[Preparation of Photoreceptors (1) to (16)]

Photoreceptors (2) to (16) each were prepared in the same manner as preparation of the Photoreceptor (1) except that a kind and an added amount of the titanium oxide particles, a kind of charge transporting material in the charge transporting layer, and presence or absence of the charge transporting material (pCTM-1) in the protective layer were changed as indicated in Table 2.

[Evaluation of Photoreceptors (1) to (16)]

Evaluation was done with an image-forming apparatus "bizhub Pro C6501" made by Konica Minolta, Inc. (tandem color multifunctional peripheral using a laser exposure, a reverse development, and an intermediate transfer member) respectively loaded with the Photoreceptors (1) to (16). Specifically, each photoreceptor was set to a black image forming location (under the condition of 20° C. and 50% RH), then an A4 image composed of yellow, magenta, cyan and black each printing rate being 2.5% was printed on a neutral paper. After printing the color image in an amount of 300,000 sheets, the electric potential of each photoreceptor was measured, and the produced image was evaluated. Evaluation of an exposure memory and evaluation of image density variation were done as described below.

<Evaluation of Exposure Memory>

The above-described Photoreceptor having finished to print 300,000 sheets of prints at 30° C. and 80% RH was placed at a position of Black (Bk). By using "POD gloss coat paper" (A3 size, 100 g/m$^2$) (made by Oji Paper, Co. Ltd.), a chart containing images of solid black, solid white, and half tone was printed out. Here, the print-out was made so that a solid black portion was outputted at the first rotation of the Photoreceptor, and a half tone image was located at the second rotation of the Photoreceptor. The observable hysteresis level of the solid image produced by the first rotation of the Photoreceptor appeared in the half tone image portion produced by the second rotation of the Photoreceptor was evaluated by the image density difference. The image density was measured by using Macbeth Densitometer Model RD-918 (made by Macbeth, Co. Ltd.).

The evaluation was made according to the following criteria. When the image density difference was smaller than 0.1 (Rank A and Ran B), it was determined that the sample passes the examination.

A: Image density difference is equal to 0.05 or less (Excellent: Passing the Examination)

B: Image density difference is more than 0.05 to less than 0.1 (No problem for practical use: passing the examination)

C: Image density difference is equal to 0.1 or more (Problem for Practical Use: Not Passing the Examination)

TABLE 2

| | Titanium oxide particles | | | Charge transporting material contained in charge transporting layer | | | |
|---|---|---|---|---|---|---|---|
| Photoreceptor No. | Kind (No.) | Added amount (Mass parts) | *1 (%) | Kind | Ionization potential(eV) | *2 | Remarks |
| 1 | (1) | 320 | 100 | tCTM-1 | 5.50 | Presence | Inventive example |
| 2 | (2) | 320 | 100 | tCTM-2 | 5.50 | Presence | Inventive example |
| 3 | (3) | 320 | 100 | tCTM-3 | 5.45 | Presence | Inventive example |
| 4 | (4) | 320 | 100 | tCTM-4 | 5.60 | Presence | Inventive example |
| 5 | (2)/(6) | 192/128 | 60 | tCTM-1 | 5.50 | Presence | Inventive example |
| 6 | (2)/(6) | 160/160 | 50 | tCTM-1 | 5.50 | Presence | Inventive example |
| 7 | (2)/(6) | 128/192 | 40 | tCTM-1 | 5.50 | Presence | Comparative example |
| 8 | (5) | 320 | 0 | tCTM-1 | 5.50 | Presence | Comparative example |
| 9 | (6) | 320 | 0 | tCTM-1 | 5.50 | Presence | Comparative example |
| 10 | (7) | 320 | 0 | tCTM-1 | 5.50 | Presence | Comparative example |
| 11 | (8) | 320 | 0 | tCTM-1 | 5.50 | Presence | Comparative example |
| 12 | (2)/(6) | 224/96 | 70 | tCTM-5 | 5.65 | Presence | Comparative example |
| 13 | (2)/(6) | 224/96 | 70 | tCTM-6 | 5.43 | Presence | Comparative example |
| 14 | (2)/(6) | 224/96 | 70 | tCTM-7 | 5.40 | Presence | Comparative example |
| 15 | (2)/(6) | 224/96 | 70 | tCTM-8 | 5.30 | Presence | Comparative example |
| 16 | (2)/(6) | 224/96 | 70 | tCTM-1 | 5.50 | Absence | Comparative example |

*1: Percentage of rutile type titanium oxide particles having an organic compound on a surface thereof

*2: Presence or absence of charge transporting material in protective layer

<Evaluation of Variation of Image Density>

The above-described Photoreceptor having finished to print 300,000 sheets of prints was set to an electric property measuring apparatus. The surface electric potential of the Photoreceptor was measured. The surface electric potential was measured by the following method. While rotating an electrophotographic photoreceptor at 130 rpm under the condition of 10° C. and 15% RH, charging and exposure were repeated to the photoreceptor under the condition of grid voltage of −800V and exposure amount of 0.5 μJ/cm$^2$. The electric potential Via after exposure of the first rotation of the photoreceptor (Initial stage) and the electric potential Vib after exposure of the 65th rotation of the photoreceptor (after 30 seconds) were respectively measured. The electric potential difference (ΔVi=Vib−Via) was determined. The evaluation of ΔVi was done according to the following criteria for the larger value obtained from before and after printing. When the electric potential difference (ΔVi) is 30 V or less, the variation of image density becomes a level which cannot be visually distinguished through control by the apparatus. Therefore, the electric potential difference (ΔVi) of 30 V or less (Rank A to Rank C) was evaluated to pass the examination. In addition, when the electric potential difference (ΔVi) was 20 V or less (Rank A and Rank B), the variation of image density becomes a level which cannot be visually distinguished even without control by the apparatus.

A: Electric potential difference (ΔVi) is equal to 10 V or less (Excellent: passing the examination)

B: Electric potential difference (ΔVi) is larger than 10 V to equal to 20 V or less (No problem for practical use: passing the examination)

C: Electric potential difference (ΔVi) is larger than 20 V to equal to 30 V or less (No problem for practical use: passing the examination)

D: Electric potential difference (ΔVi) is larger than 30 V (Problem for practical use: not passing the examination)

TABLE 3

| Photoreceptor No. | Exposure memory | Variation of image density | Remarks |
|---|---|---|---|
| 1 | A | A | Inventive example |
| 2 | A | A | Inventive example |
| 3 | B | A | Inventive example |
| 4 | A | B | Inventive example |
| 5 | A | B | Inventive example |
| 6 | A | C | Inventive example |
| 7 | A | D | Comparative example |
| 8 | A | D | Comparative example |
| 9 | A | D | Comparative example |
| 10 | C | A | Comparative example |
| 11 | C | A | Comparative example |
| 12 | A | D | Comparative example |
| 13 | C | B | Comparative example |
| 14 | C | A | Comparative example |
| 15 | C | A | Comparative example |
| 16 | A | D | Comparative example |

As demonstrated by the results listed in Table 3, it is recognized that the Photoreceptors of the present invention hardly produce an exposure memory and variation of image density. On the other hand, the comparative Photoreceptors exhibited inferior results to at least one of these evaluation items.

What is claimed is:

1. An electrophotographic photoreceptor comprising a conductive support having thereon an intermediate layer, a charge generating layer, a charge transporting layer, and a protective layer sequentially laminated in that order, wherein the intermediate layer contains rutile type titanium oxide particles, 50% or more of the rutile type titanium oxide particles have an organic compound on a surface of the titanium oxide particles, and the rutile type titanium oxide particles having the organic compound are formed by subjecting untreated rutile type titanium oxide particles to a surface treatment with an organic compound only;

the charge generating layer has a pigment containing a 2,3-butanediol adduct of a phthalocyanine compound;

the charge transporting layer contains a first charge transporting material having an ionization potential of 5.45 to 5.60 eV;

the protective layer contains metal oxide particles and second charge transporting material in a cured resin prepared by curing a polymerizable compound the first charge transporting material is selected from the group consisting of triphenylamine derivatives, hydrazone compounds, styryl compounds, benzidine compounds, and butadiene compounds; and the second charge transporting material is a compound represented by Formula (1)

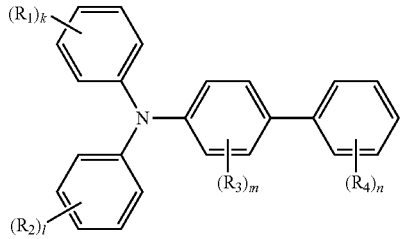

wherein $R_1$, $R_2$, $R_3$ and $R_4$ each respectively represents a hydrogen atom, an alkyl group of 1 to 7 carbon atoms, or an alkoxy group of 1 to 7 carbon atoms, k, l, and n each respectively represents an integer of 1 to 5, and m represents an integer of 1 to 4.

2. The electrophotographic photoreceptor described in claim 1, wherein the organic compound on the surface of the titanium oxide particles is a reactive organosilicon compound.

3. The electrophotographic photoreceptor described in claim 2, wherein the reactive organosilicon compound is at least one selected from the group consisting of 3-methacryloxy propyl trimethoxy silane, 3-acryloxy propyl trimethoxy silane, and methyl hydrogen polysiloxane.

4. An image-forming apparatus provided with the electrophotographic photoreceptor described in claim 1, a charging unit to charge the electrophotographic photoreceptor, an exposing unit, a developing unit, and a transferring unit.

* * * * *